US007566121B2

(12) United States Patent
Ohishi

(10) Patent No.: US 7,566,121 B2
(45) Date of Patent: Jul. 28, 2009

(54) INK JET RECORDING APPARATUS

(75) Inventor: Chikashi Ohishi, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 324 days.

(21) Appl. No.: 11/328,141

(22) Filed: Jan. 10, 2006

(65) Prior Publication Data

US 2006/0152562 A1 Jul. 13, 2006

(30) Foreign Application Priority Data

Jan. 12, 2005 (JP) ..... 2005-004965

(51) Int. Cl.
*B41J 2/18* (2006.01)
*B41J 2/175* (2006.01)

(52) U.S. Cl. ..... 347/89; 347/93

(58) Field of Classification Search ..... 347/20, 347/21, 22, 28, 85, 89, 92, 93
See application file for complete search history.

(56) References Cited

U.S. PATENT DOCUMENTS 4,862,192 A * 8/1989 Slomianny ..... 347/7
5,793,395 A * 8/1998 Tanaka et al. ..... 347/85
5,963,237 A * 10/1999 Ikkatai et al. ..... 347/85
6,283,585 B1 * 9/2001 Ikkatai et al. ..... 347/85
6,443,560 B1 * 9/2002 Okano et al. ..... 347/55
6,588,339 B2 * 7/2003 Naniwa et al. ..... 101/465
6,655,791 B1 * 12/2003 Crockett et al. ..... 347/85
6,655,867 B2 * 12/2003 Omatsu et al. ..... 401/142
7,128,404 B2 * 10/2006 Kodama ..... 347/68
7,182,444 B2 * 2/2007 Kawamoto ..... 347/85
7,198,361 B2 * 4/2007 Hida ..... 347/93

FOREIGN PATENT DOCUMENTS

JP 10-244690 A 9/1998

* cited by examiner

*Primary Examiner*—Anh T. N. Vo
(74) *Attorney, Agent, or Firm*—Sughrue Mion, PLLC

(57) ABSTRACT

An ink jet recording apparatus has an ink jet head for ejecting ink. The ink jet recording apparatus includes a main tank for reserving the ink; a supply sub-tank for reserving the ink supplied from the main tank and supplying the ink to the ink jet head with a static pressure method; an ink circulation system including a first supply piping for connecting the main tank and the supply sub-tank to each other; and a filter provided on an ink circulation path of the ink circulation system on an ink jet head side with respect to a gas-liquid interface of the supply sub-tank at a time of ink circulation. The ink circulation system circulates the ink among the main tank, the supply sub-tank and the ink jet head. The ink circulation system is constructed so that at least a part of the ink passed through the first supply piping is directly ejected to one of a surface of the filter on an ink jet head side and a surface of the filter on a gas-liquid interface side.

20 Claims, 5 Drawing Sheets

INK JET RECORDING APPARATUS

The entire contents of literatures cited in this specification are incorporated herein by reference.

BACKGROUND OF THE INVENTION

The present invention relates to an ink jet recording apparatus that performs recording by ejecting ink toward a recording medium. More specifically, the present invention relates to an ink jet recording apparatus that performs recording by supplying ink to an ejection head by a static pressure method and by ejecting the ink from the ejection head.

As an ink jet recording apparatus that performs recording by ejecting ink toward a recording medium, there is provided, for example, an electrostatic ink jet recording system in which an electrostatic force is caused to act on ink to eject ink droplets. As one type of the electrostatic ink jet recording system, there is known an ink jet recording apparatus using ink obtained by dispersing a charged fine particle component containing colorant and resin (hereinafter referred to as "colorant particles") in an insulative carrier liquid (dispersion medium) and performs recording with a method with which an image is recorded onto a recording medium in an on-demand manner through control of ejection of the ink in which an electrostatic force is caused to act on the ink by applying voltages (drive voltages) to ejection electrodes of an ink jet head in accordance with image data.

In the electrostatic ink jet recording that uses the ink containing the colorant particles, the electrostatic force is caused to act on the ink at ink ejection portions (and near the ejection portions) by applying drive voltages to the ejection electrodes formed in correspondence with the ejection portions under a state in which the recording medium is charged to a bias voltage and is set to face the ink jet head, for instance.

Through the application of the electrostatic force, the colorant particles migrate and gather at the ejection portions (that is, the ink is concentrated at the ejection portions) and are ejected as ink droplets.

As a method of supplying the ink to each ejection portion in the electrostatic ink jetting system, for instance, it is possible to use a method with which the ink is circulated through a predetermined circulation path in which the ink is supplied from a tank reserving the ink to the ink jet head, the ink is caused to flow through a predetermined ink flow path communicating with each ejection portion in the ink jet head, and the ink not ejected and passed through the ink flow path is returned from the ink jet head to the tank.

For instance, JP 10-244690 A discloses an ink jet recording apparatus as shown in FIG. 6 which records an image on a recording medium P by ejecting ink containing colorant particles from an electrostatic ink jet head (hereinafter referred to as "recording head") 200, and includes a circulation, system that supplies the ink from a tank 202 reserving the ink to a tank 206 with a pump 204, supplies the ink from the tank 206 to the recording head 200 through a gravity drop under a water head pressure, and returns the ink not ejected from the recording head 200 to the tank 202. In addition, the ink jet recording apparatus includes a tank 210 in which degraded ink is disposed, and a tank 214 in which new (unused) ink is reserved.

Also, in the ink jet recording apparatus, a degradation state of the circulated ink is detected. When a result of the detection indicates that the ink is degraded, the pump 204 is stopped, all of the ink in the tank 206 is recovered to the tank 202, and the degraded ink is then disposed in the tank 210 by opening a valve 208. When the tank 202 becomes empty, the new ink is supplied from the tank 214 to the tank 202 by opening a valve 212 and circulation is performed again.

Here, the ink jet recording apparatus disclosed in JP 10-244690 A is capable of supplying the ink at a constant pressure by supplying the ink from the tank 206 to the recording head (ejection head) 200 through a gravity drop under a water head pressure but has a possibility that coagulation solid matter is formed on an inner wall surface of the tank 206, a possibility that coagulation solid matter or the like is generated in the tank 206 due to evaporation of the ink at a gas-liquid interface at which the ink contacts the air, a possibility that dust will enter into the tank 206, and the like.

When foreign matter such as the dust and the coagulation solid matter is mixed into the ink and the ink containing the foreign matter is supplied to the recording head 200, ejection ports (nozzles) of the recording head may be clogged with the foreign matter and the ejection of ink droplets may become impossible.

Regarding this problem, the inventor of the present invention have found that in the ink jet recording apparatus that uses the sub-tank supplying the ink to the recording head with a static pressure method, by providing a filter that removes the foreign matter between the recording head and the sub-tank, it becomes possible to remove the foreign matter generated in the tank which supplies the ink to the recording head, and also prevent the recording head from being clogged with the foreign matter.

By providing the filter between the recording head and the sub-tank in the manner described above, it becomes possible to prevent the foreign matter from entering into the recording head. With this construction, however, there is a case where the ink remains in the filter even after the ink jet recording apparatus is temporarily stopped after use and the ink is extracted from the ink circulation system including the ink jet head and is returned to a main tank or the like. When the ink remains in the filter, depending on a static pressure applied to the recording head, the ink may become incapable of passing through the filter at the time of start of the ink supply to the recording head (at the time of start of the ink circulation) due to surface tension of the ink in the filter or the like and flow of the ink may be blocked by the filter. When the flow of the ink is blocked by the filter in the manner described above, there occurs a problem in that the ink is not supplied to the recording head and image recording becomes impossible.

SUMMARY OF THE INVENTION

An object of the present invention is to solve the problems as described above, and to provide an ink jet recording apparatus including a sub-tank for supplying ink to a recording head (ink jet head) with a static pressure method, being capable of supplying the ink to the ink jet head without causing blockage of the ink supply by the filter at the time of start of the ink supply to the ink jet head even when a filter is provided between the ink jet head and the sub-tank, and having a simple construction.

In order to attain the above-mentioned objects, an aspect of the present invention provides an ink jet recording apparatus having an ink jet head for ejecting ink, the ink jet recording apparatus including: a main tank for reserving the ink; a supply sub-tank for reserving the ink supplied from the main tank and supplying the ink to the ink jet head with a static pressure method; an ink circulation system including a first supply piping for connecting the main tank and the supply sub-tank to each other, the ink circulation system circulating the ink among the main tank, the supply sub-tank and the ink jet head; and a filter provided on an ink circulation path of the ink circulation system on an ink jet head side with respect to a gas-liquid interface of the supply sub-tank at a time of ink circulation, wherein the ink circulation system is constructed so that at least a part of the ink passed through the first supply piping is directly ejected to one of a surface of the filter on an ink jet head side and a surface of the filter on a gas-liquid interface side.

It is preferable that the ink circulation system include a second supply piping for connecting the supply sub-tank and the ink jet head to each other, and the filter be inserted between the supply sub-tank and the second supply piping.

It is preferable that the ink be obtained by dispersing fine particles containing at least a resin and a colorant in a solvent.

It is preferable that the ink circulation system further include a branch piping branching from the first supply piping, and the ink branched from the first supply piping be directly ejected from the branch piping to the surface of the filter on the ink jet head side.

It is preferable that the branch piping include an opening for ejecting the ink, and the opening be opposed to the surface of the filter on the ink jet head side.

It is preferable that the supply sub-tank include a connection port for connection with the first supply piping, and the connection port be formed in proximity to the filter so that the ink ejected from the connection port directly impinges on the surface of the filter on the gas-liquid interface side.

It is preferable that the supply sub-tank include a connection port in a lowermost position thereof for connection with the first supply piping, and the ink reserved in the supply sub-tank be recovered to the main tank through the first supply piping when the ink circulation is stopped.

It is preferable that the filter be a first filter and the ink jet recording apparatus further include a second filter provided between the main tank and the sub-tank for ink supply circulation system.

It is preferable that the ink jet recording apparatus according to the present invention further include liquid feed means for feeding the ink from the main tank to the supply sub-tank through the first supply piping, wherein the liquid feed means feeds the ink passed through the second filter to the supply sub-tank.

It is preferable that the supply sub-tank be arranged at a position higher than the ink jet head, and supply the ink to the ink jet head while keeping a height of an ink liquid surface constant through overflowing.

It is preferable that the ink jet recording apparatus according to the present invention further include a recovery sub-tank for recovering the ink from the ink jet head. Further, it is preferable that the recovery sub-tank be arranged at a position lower than the ink jet head, and recover the ink from the ink jet head while keeping a height of an ink liquid surface constant through overflowing.

It is preferable that the recovery sub-tank include a connection port in a lowermost position thereof for connection with a third supply piping connected to the main tank, and the ink reserved in the supply sub-tank be recovered to the main tank through the third supply piping when the ink circulation is stopped.

It is preferable that the ink jet recording apparatus according to the present invention further include: capping means for lidding ink ejection ports of the ink jet head when attached to the ink jet head; and a communication piping for connecting the supply sub-tank and at least one of the capping means and the ink jet head to each other. Further, it is preferable that communication ports be formed in capping surfaces of the capping means and the ink jet head, the communication ports being connected to the communication piping for allowing air in at least one of the supply sub-tank and the main tank to communicate with outside air; and the communication with the outside air through the communication piping be cut off by attaching the capping means to the ink jet head, and the communication with the outside air through the communication piping be established by detaching the capping means from the ink jet head.

It is preferable that the ink jet recording apparatus according to the present invention further include ink replenishment means including at least a high concentration ink replenishment portion for replenishing the main tank with high concentration ink and a diluent replenishment portion for replenishing the main tank with a diluent.

It is preferable that the diluent replenishment portion be connected to a circulation system that circulates the diluent through the supply sub-tank and the ink jet head.

According to the present invention, an ink jet recording apparatus including a sub-tank for supplying ink to a recording head (ink jet head) with a static pressure method is provided, with which it is possible to prevent flow of the ink from being blocked by a filter provided between the ink jet head and the sub-tank at the time of start of the ink supply (at the time of start of ink circulation), suitably supply the ink from which foreign matter has been removed by the filter to the ejection head, and prevent ejection portions of the ink jet head from being clogged with the foreign matter.

In addition, according to the present invention, it becomes possible to use a simple apparatus construction, which makes it possible to achieve a reduction in apparatus cost.

DETAILED DESCRIPTION OF THE PREFERRED EMBODIMENTS

Hereinafter, the ink jet recording apparatus according to the present invention will be described in detail based on preferred embodiments illustrated in the accompanying drawings.

Figure 1:
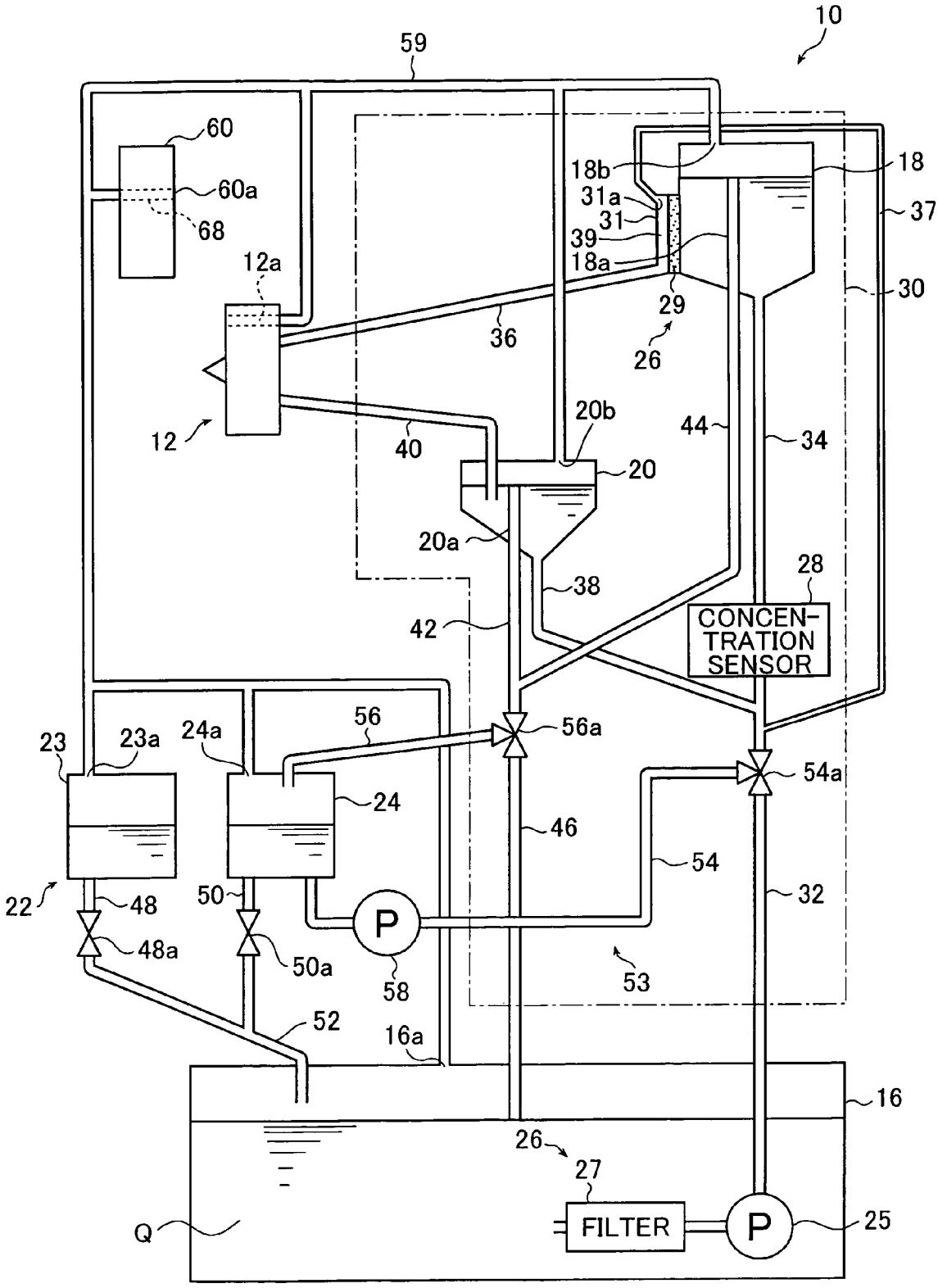
FIG. 1 is a conceptual diagram of an embodiment of the ink jet recording apparatus according to the present invention.

FIG. 1 conceptually shows an embodiment of the ink jet recording apparatus according to the present invention.

An ink jet recording apparatus (hereinafter referred to as "recording apparatus") 10 shown in FIG. 1 is an electrostatic ink jet recording apparatus that uses ink Q obtained by dispersing charged fine particles (hereinafter referred to as "colorant particles") containing colorant and resin in an insulative carrier liquid (dispersion medium) and ejects ink droplets by applying an electrostatic force onto the ink. As shown in FIG. 1, the recording apparatus 10 basically includes an ejection head (ink jet head) 12, a main tank 16, ink replenishment means 22, an ink circulation pump 25, foreign matter removal means 26, an ink circulation path 30, cleaning means 53, a communication piping 59, and a capping member 60.

The ink circulation path 30 of the recording apparatus 10 mainly includes an ink supply path for supplying the ink Q in the main tank 16 to the ejection head 12 and an ink recovery path for recovering the ink Q not ejected from the ejection head 12. The ink supply path mainly includes a supply sub-tank 18, a common supply piping 32 connected to the ink circulation pump 25, a first supply piping 34 that connects the common supply piping 32 and the supply sub-tank 18 to each other, a third supply piping 38 that connects the common supply piping 32 and a recovery sub-tank 20 to each other, a second supply piping 36 that connects the supply sub-tank 18 and the ejection head 12 to each other, and a third recovery piping 44 that recovers the ink Q overflowed into an overflow pipe 18*a* in the supply sub-tank 18. Also, the ink recovery path mainly includes the recovery sub-tank 20, a first recovery piping 40 that connects the ejection head 12 and the recovery sub-tank 20 to each other, a second recovery piping 42 that recovers the ink overflowed into an overflow pipe 20*a* in the recovery sub-tank 20, and a common recovery piping 46 that recovers the ink recovered by the second recovery piping 42 and the third recovery piping 44 to the main tank 16. It is possible to construct the supply pipings and the recovery pipings using pipes, flexible tubes or the like.

It should be noted here that FIG. 1 mainly shows characteristic sites of the present invention, and as a matter of course, in addition to the ink circulation system shown in FIG. 1, the recording apparatus 10 according to the present invention includes various construction elements possessed by known electrostatic ink jet recording apparatuses, such as a driver that drives the ejection head 12 to eject ink droplets, scanning and conveying means for conveying (scanning and conveying) a recording medium P in a direction orthogonal to an ejection port row direction (line direction) to be described later through a predetermined path opposing the ejection head 12, charging means (or a counter electrode corresponding to control electrodes of the ejection head 12) for charging the recording medium P with a predetermined bias voltage prior to image recording by the ejection head 12, electrostatic elimination means for performing electrostatic elimination to the recording medium P, conveying means for conveying the recording medium P through a predetermined path, a sensor that detects the conveyed recording medium P, and solvent discharge means for discharging a carrier liquid or the like remaining in the apparatus.

Also, it does not matter whether the ink jet recording apparatus according to the present invention is a monochrome recording apparatus that performs monochrome image recording using only K (black) ink or the like, or a recording apparatus that draws full-color images on a recording medium using ink in four colors of Y (yellow), M (magenta), C (cyan) and K.

Further, the ejection head is not limited to the electrostatic ink jet head and various other ink jet heads are suitably usable, examples of which are a thermal ink jet head and an ink jet head of a type that ejects ink by vibrating a diaphragm in an ink chamber using a piezo element, a micromachine or the like.

The main tank 16 is an enclosed ink tank that mainly reserves the ink circulated through the ink circulation path 30 of the recording apparatus 10.

In the main tank 16, the ink circulation pump 25 that circulates the ink through the ink circulation path 30 and a filter 27 of the foreign matter removal means 26 are arranged. The filter 27 is connected to the ink circulation pump 25. The filter 27 will be described in detail later.

One end of the ink circulation pump 25 is connected to the filter 27 and the other end thereof is connected to the common supply piping 32. The ink circulation pump 25 sucks the ink in the main tank 16 through the filter 27 and supplies it to the common supply piping 32. The ink circulation pump 25 is a non-self-contained pump with which the ink is supplied to the common supply piping 32 during operation and the ink in the common supply piping 32 is not held and is recovered into the main tank 16 by gravitation during non-operating state. Here, examples of the non-self-contained pump are a centrifugal pump such as a volute pump or a diffuser pump, an axial flow pump, and a mixed flow pump. Also, it is preferable that a volute pump be used as the ink circulation pump 25 because the pump does not include a rotation slide portion at a liquid-contact portion that is a cause of coagulation/adhesion of ink particles.

It is preferable that the main tank 16 further includes agitation means for preventing settlement/accumulation of the colorant particles from occurring and temperature adjustment means for improving stability of ink ejection.

As described above, the recording apparatus 10 shown in FIG. 1 includes the supply sub-tank 18, the recovery sub-tank 20, and the ink circulation path 30 constructed by the pipings connecting them to each other. The recording apparatus 10 is a static pressure ink jet recording apparatus that supplies the ink to the ejection head 12 by circulating the ink Q reserved in the main tank 16 through the ink circulation path 30.

One end of the common supply piping 32 is connected to the ink circulation pump 25 and the other end thereof is connected to the first supply piping 34 and the third supply piping 38. The ink supplied from the ink circulation pump 25 to the common supply piping 32 is supplied to the first supply piping 34 and the third supply piping 38.

The supply sub-tank 18 is an enclosed ink tank to which the first supply piping 34 and the second supply piping 36 are connected, and is arranged at a position higher than the ejection head 12 in a vertical direction. Here, the supply sub-tank 18 is connected to the second supply piping 36 through a filter 29 and a gap 39. The filter 29 and the gap 39 will be described in detail later. Also, the other end of the second supply piping 36 which is connected to the supply sub-tank 18 at one end is connected to the ejection head 12.

The supply sub-tank 18 has a shape in which a hollow inverted quadrilateral pyramid, whose upper portion (bottom surface) is opened, is provided below a hollow square pole whose lower surface is opened. Accordingly, the bottom surface (floor surface) of the supply sub-tank 18 has no horizontal portion and is inclined toward a point (lowermost portion). An opening is formed in the lowermost portion and is connected to the first supply piping 34.

In the supply sub-tank 18, the ink Q supplied from the main tank 16 through the common supply piping 32 and the first supply piping 34 is reserved. The reserved ink Q is supplied to the ejection head 12 through the second supply piping 36.

Also, the overflow pipe 18*a* connected to the third recovery piping 44 is provided in the supply sub-tank 18. The second supply, piping 36 is connected to the supply sub-tank 18 at a position lower than the upper end of the overflow pipe 18*a*. In the illustrated example, a construction is used in which a connection portion of the supply sub-tank 18 with the second supply piping 36 is provided in a bottom surface of the supply sub-tank 18.

The ink reserved in the supply sub-tank 18 is supplied to the ejection head 12 through the second supply piping 36 as a result of a gravity drop at a pressure corresponding to a difference of altitude (difference of elevation) between the supply sub-tank 18 and the ejection head 12 (or the recovery sub-tank 20).

Also, when the ink supplied by the ink circulation pump 25 exceeds the height of the overflow pipe 18*a* in the supply sub-tank 18, it overflows and is discharged through the overflow pipe 18*a*, so the height of a liquid surface in the tank is kept constant. As a result, the supply amount and supply pressure (pressure head) of the ink Q from the supply sub-tank 18 to the ejection head 12 are kept constant and ink supply in a so-called static pressure system is performed.

It should be noted here that the ink Q discharged through the overflow pipe 18*a* is returned to the main tank 16 through the third recovery piping 44 and the common recovery piping 46 to be circulated again.

The recovery sub-tank 20 is an enclosed ink tank to which the first recovery piping 40, the second recovery piping 42 and the third supply piping 38 are connected, and is provided at a position lower than the ejection head 12 in the vertical direction. The recovery sub-tank 20 has a shape in which a hollow inverted quadrilateral pyramid, whose upper portion (bottom surface) is opened, is provided below a hollow square pole whose lower surface is opened. Accordingly, the bottom surface (floor surface) of the recovery sub-tank 20 has no horizontal portion and is inclined toward a point (lowermost portion). An opening is formed in the lowermost portion and is connected to the third supply piping 38.

As described above, the other end of the first recovery piping 40 is connected to the ejection head 12 and the other end of the second recovery piping 42 is connected to the common recovery piping 46.

The ink Q in the main tank 16 is supplied to the recovery sub-tank 20 through the third supply piping 38, and the ink Q not ejected from the ejection head 12 is reserved in the recovery sub-tank 20 through the first recovery piping 40. The ink Q reserved in the recovery sub-tank 20 is returned to the main tank 16 through the second recovery piping 42 and the common recovery piping 46.

Here, the ink Q not ejected from the ejection head 12 and discharged from the ejection head 12 is supplied to the recovery sub-tank 20 through the first recovery piping 40 as a result of a gravity drop at a pressure corresponding to a difference of altitude (difference of elevation) between the ejection head 12 (or the supply sub-tank 18) and the recovery sub-tank 20. The ink Q overflowed into the overflow pipe 20*a* in the recovery sub-tank 20 is returned to the main tank 16 through the second recovery piping 42 to be circulated again.

Also, the ink liquid surface in the recovery sub-tank 20 is kept constant by the overflow pipe 20*a*. As a result, also to ink inflow from the ejection head 12, a constant pressure (pressure head) is applied, which corresponds to the height of the liquid surface in the recovery sub-tank 20. That is, it is possible to apply a constant static pressure to the ejection head 12.

In the recording apparatus 10, in the manner described above, the ink is supplied from the supply sub-tank 18 to the ejection head 12 with a constant pressure head of the ink reserved in the supply sub-tank 18, and a constant pressure is applied also to the ink supply from the ejection head 12 to the recovery sub-tank 20. As a result, it becomes possible to set a pressure relating to an ink flow path formed in the ejection head 12, that is, ink supply and discharge to and from the ejection head 12 at a completely static pressure, which makes it possible to stabilize meniscuses of the ink Q formed at ejection ports of the ejection head 12 to be described later and the like.

In the recording apparatus 10 of this embodiment, it is also possible to select with a high degree of flexibility the height of the meniscuses of the ink Q formed at the ejection ports of the ejection head by setting the height of at least one of the supply sub-tank 18 and the recovery sub-tank 20 as appropriate. Accordingly, it is preferable that height adjustment means for adjusting the height of the supply sub-tank 18 and/or the recovery sub-tank 20 be provided to make it possible to control the state and height of the meniscuses.

It should be noted here that the height adjustment means is capable of using various methods so long as height adjustment in the vertical direction is possible. For instance, the height adjustment means uses a method based on a screw axis and a nut that mesh with each other, a method using a cylinder and an actuator, or a method using a cam.

Next, an operation of the ink circulation system during operation of the recording apparatus 10 (at the time of recording) will be described. During operation, first, the ink is fed by the ink circulation pump 25 from the main tank 16 to the supply sub-tank 18 and the recovery sub-tank 20 through the common supply piping 32, the first supply piping 34 and the third supply piping 38 to be reserved in the supply sub-tank 18 and the recovery sub-tank 20. The ink Q reserved in the supply sub-tank 18 flows into the ejection head 12 through the second supply piping 36 due to a difference of elevation between the supply sub-tank 18 and the ejection head 12. The ink Q not ejected from the ejection head 12 is sent to the recovery sub-tank 20 through the first recovery piping 40 due to a difference of elevation between the ejection head 12 and the recovery sub-tank 20. The ink Q overflowed the recovery sub-tank 20 is returned to the main tank 16 through the second recovery piping 42 and the common recovery piping 46. In the manner described above, the ink Q is circulated from the main tank 16 to the supply sub-tank 18, the ejection head 12, and the recovery sub-tank 20.

It should be noted here that the ink Q overflowed the supply sub-tank 18 is returned to the main tank 16 through the third recovery piping 44 and the common recovery piping 46.

Here, the ink in the third supply piping 38 does not directly contribute to ejection of ink droplets, so it is preferable that the flow rate of the ink flowing through the first supply piping 34 be adjusted to be higher than the flow rate of the ink flowing through the third supply piping 38. With this construction, it becomes possible to supply the ink to the ejection head 12 with efficiency. As an ink flow rate adjustment method, it is possible to use various methods. For instance, a method with which the pipe diameter of the first supply flow path 34 is set larger than the pipe diameter of the third supply flow path 38, or a method with which the flow rate is adjusted by disposing an orifice or an adjustment valve midway through the third supply flow path 38, is used.

As described above, the openings formed in the lowermost portions of the supply sub-tank 18 and the recovery sub-tank 20 are respectively connected to the first supply piping 34 and the third supply piping 38, so at the time of driving, constant amounts of the ink are supplied to the supply sub-tank 18 and the recovery sub-tank 20. By supplying the constant amounts of the ink in a manner described above, it becomes possible to keep the liquid surfaces of the ink in the supply sub-tank 18 and the recovery sub-tank 20 constant.

When the recording is finished, the recording apparatus 10 stops the ink circulation pump 25. In this embodiment, the openings are provided in the lowermost portions of the supply sub-tank 18 and the recovery sub-tank 20, and are respectively connected to the first supply piping 34 and the third supply piping 38. Therefore, when force acting from the ink circulation pump 25 on the supply pipings is stopped, the ink in the supply sub-tank 18 and the recovery sub-tank 20 is recovered to the main tank 16 through the first supply piping 34 and the third supply piping 38 by gravitation. In addition, the ink in the ejection head 12, the second supply flow path 36, and the first recovery flow path 40 is also recovered to the main tank 16 through the recovery sub-tank 20, the third supply flow path 38, and the common supply flow path 32.

When recording is not performed (when the pump is stopped), the ink in the ejection head 12, the supply sub-tank 18, the recovery sub-tank 20, and the pipings connecting them with one another is automatically recovered to the main tank 16 in the manner described above, so the ink is prevented from remaining in the ejection head 12 and the circulation path 30, and adhesion of the ink and the like are prevented from occurring even when the apparatus is not used for a long time.

Also, by preventing the adhesion of the ink from occurring, it becomes possible to suppress contaminations in the circulation path, which makes it possible to reduce the number of times of cleaning of the circulation path or eliminate the necessity of the cleaning.

It should be noted here that even when the common supply piping 32 and the common recovery piping 46 are pipings produced using a flexible material such as resin, it is preferable that the pipings be provided to be directed, for example, vertically, or approximately vertically, so that the ink is recovered to the main tank 16 by gravitation at least when recording is not performed. Further, it is more preferable that the pipings be provided so that the ink is recovered to the main tank 16 by gravitation at all times. With this construction, even in the case of a structure of a serial type or the like in which the ejection head and the main tank move relative to each other, it becomes possible to suitably return the ink to the main tank.

Here, it is preferable that the supply sub-tank 18 and the recovery sub-tank 20 be constructed so that their bottom surfaces have shapes with no horizontal portion. By constructing the tanks in the shapes in which the bottom surfaces have no horizontal portion, it becomes possible to prevent the ink from remaining in the tanks when the pump is stopped.

Also, it is preferable that the ink circulation path include no horizontal portion, that is, the ink circulation path be constructed only with pipings that are each arranged to be inclined or vertically, as shown in FIG. 1. By constructing the ink circulation path with the inclined and vertically arranged pipings in the manner described above, when the pump is stopped, the ink in the ink circulation path is easy to flow to a main tank side, which makes it possible to prevent the ink from remaining in the ink circulation path with more reliability.

Further, it is preferable that the ink circulation pump be a non-self-contained pump like in this embodiment. By using a non-self-contained pump, it becomes possible to recover the ink into the main tank without allowing the ink to remain in the supply flow path when the pump is stopped.

Next, the foreign matter removal means 26 will be described.

The foreign matter removal means 26 removes foreign matter mixed into the ink and includes the filter 27 and the filter 29.

The filter 27 is connected to the ink circulation pump 25, and is capable of removing substances which are mixed into the ink in the main tank 16 and have sizes with which they may become foreign matter when entered at least into the ejection head 12 and the ink circulation path 30. Here, it is preferable that a mesh filter be used as the filter 27. By using the mesh filter, it becomes possible to suitably remove such substances, which have sizes with which they may become foreign matter when entered at least into the ejection head 12 and the ink circulation path 30, without hindering smooth ink circulation. In particular, when the mesh filter has a mesh size of 30 to 70 μm, it becomes possible to achieve both of smoother ink circulation and foreign matter removal.

By providing the filter 27 on an ink suction side of the ink circulation pump 25 in the manner described above, it becomes possible to supply the ink from which foreign matter has been removed to the ink circulation path 30.

Here, the filter 27 is not limited to the mesh filter, and a sponge filter, a nonwoven fabric or the like may be used instead. When a sponge filter, a nonwoven fabric or the like is used as the filter 27, a sponge filter of an open-cell type or a nonwoven fabric, such as a three-dimensional nonwoven fabric, which is of a three-dimensional type and whose mesh has a gradient of density from coarse to dense is particularly preferable because it is hard to be clogged and lasts long.

The filter 29 is inserted between the supply sub-tank 18 and the second supply piping 36.

The filter 29 is accommodated in a filter accommodation part 31 provided on an outer side surface of the supply sub-tank 18. The filter accommodation part 31 is a hollow rectangular parallelepiped whose width (width in a depth direction in FIG. 1) is approximately the same as that of the second supply piping 36. The filter accommodation part 31 is provided so that its upper end is positioned lower than the liquid surface of the ink in the supply sub-tank 18.

The inside of the filter accommodation part 31 is connected to the inside of the supply sub-tank 18 and the ink in the supply sub-tank 18 is sent to the second supply piping 36 through the filter in the filter accommodation part 31.

As shown in FIG. 1, the filter 29 is arranged on the supply sub-tank 18 side in the filter accommodation part 31. The gap 39 is formed between a surface of the filter 29 opposite to that on the supply sub-tank 18 side and an inner wall of the filter accommodation part 31. Also, an opening to which a branch piping 37 is connected is formed in an upper portion of the filter accommodation part 31, and an opening to which the second supply piping 36 is connected is formed in a lower portion of the filter accommodation part 31 so that the filter accommodation part 31 communicates with the gap 39.

In this embodiment, the filter accommodation part 31 having the rectangular parallelepiped shape with the same width as the second supply piping 36 has been described as an example but the present invention is not limited to this. For instance, the width of the filter accommodation part 31 may be set wider than that of the second supply piping 36. Also, the filter accommodation part 31 may be constructed in a cylindrical shape. Further, the filter accommodation part 31 may be provided on an inner side wall of the supply sub-tank 18.

Like the filter 27 described above, the filter 29 removes substances having sizes with which they may become foreign matter when entered into the ejection head 12 (and the ink circulation path 30). Here, it is possible to obtain the filter 29 using various materials, such as metals and resins, and in particular, it is preferable to use a sintered metallic mesh in terms of chemical resistance, durability, mechanical strength, and the like.

Also, the mesh size of the filter 29 is preferably set at 5 to 200 μm, more preferably 20 to 100 μm, and further preferably 30 to 60 μm. When the mesh size of the filter 29 is 5 μm or more, it becomes possible to circulate the ink smoothly. When the mesh size is 200 μm or less, it becomes possible to suitably remove substances having sizes with which they may become foreign matter when entered into the ejection head 12 (and the ink circulation path 30). Also, by setting the mesh size at 20 to 100 μm, it becomes possible to provide a higher effect, and by setting the mesh size at 30 to 60 μm, it becomes possible to provide a still higher effect.

Like the filter 27, the filter 29 is not limited to the mesh filter and a sponge filter, a nonwoven fabric, or the like may be used instead. When a sponge filter, a nonwoven fabric or the like is used as the filter 29, a sponge filter of an open-cell type or a nonwoven fabric, such as a three-dimensional nonwoven fabric, which is of a three-dimensional type and whose mesh has a gradient of density from coarse to dense is particularly preferable because it is hard to be clogged and lasts long.

By providing the filter 29 on an ink jet head 12 side with respect to a gas-liquid interface of the supply sub-tank 18 in the manner described above, it becomes possible to remove foreign matter which is generated in the circulation path 30 and is incapable of being removed with the filter 27, more specifically, foreign matter generated as a result of generation of coagulation/adhesion matter at the gas-liquid interface of the supply sub-tank 18 and in the supply sub-tank 18, mixing of dust and the like.

As a result, it becomes possible to supply to the ejection head 12 the ink from which the coagulation/adhesion matter generated at the gas-liquid interface of the supply sub-tank 18 and in the supply sub-tank 18, the dust entered into the supply sub-tank 18 and the like have been removed through the filter 29.

Here, when the filter is provided between the static pressure supply sub-tank and the ink jet head (on an ejection head side with respect to the gas-liquid interface of the supply sub-tank) in the manner described above, even after ink circulation is temporarily stopped (pump is stopped), and the ink is extracted from the ejection head and the ink circulation path to be returned to the main tank after use of the ink jet recording apparatus, the ink may remain in the filter. In this case, at the time of start of the ink supply to the ejection head (at the time of start of the circulation), the ink in the supply sub-tank may be prevented from passing the filter due to surface tension of the ink remaining in the filter, which may make it difficult to supply ink to the ejection head.

In view of this problem, in this embodiment, the branch piping 37 is provided to prevent the ink in the supply sub-tank from not passing the filter 29 due to the surface tension of the ink in the filter 29 and the like at the time of start of the ink supply to the ejection head 12 (at the time of start of the ink circulation).

The branch piping 37 is a branch pipe branched from the common supply piping 32 and its tip end is connected to the filter accommodation part 31. That is, an opening for connection with the branch piping 37 is formed in the upper portion of the filter accommodation part 31, and the tip end of the branch piping 37 is connected to the opening. An opening surface of the filter accommodation part 31 connected to the branch piping 37 is formed for the filter accommodation part 31 so as to be opposed to a surface of the filter 29 on the ejection head 12 side.

When the ink circulation in the recording apparatus 10 is started, the ink is supplied from the ink tank 16 to the branch piping 37 through the common supply piping 32. The ink supplied to the branch piping 37 is ejected to the gap 39 in the filter accommodation part 31. Here, the opening surface of the opening 31*a* in the upper portion of the filter accommodation part 31 is formed to be opposed to the surface of the filter 29 as described above, so the ink passed through the common supply piping 32 and the branch piping 37 is directly ejected from the upper opening 31*a* of the filter accommodation part 31 to the surface of the filter 29 on the ejection head 12 side. As a result, the surface of the filter 29 on the ejection head 12 side becomes wet with the ink. That is, a part of the ink supplied from the main tank 16 to the supply sub-tank 18 impinges on the filter 29 at a predetermined flow speed or more, and the surface of the filter 29 on the ejection head 12 side becomes wet with the ink. In this embodiment, the ink at the predetermined flow speed is directly ejected to the surface of the filter 29 on the ejection head 12 side, thereby wetting the surface of the filter 29.

In FIG. 1, the branch piping 37 passes over the supply sub-tank 18 to be connected to the filter accommodation part 31. However, in the present invention, the way of arrangement of the branch piping 37 is not specifically limited. For example, in FIG. 1, it may be such that the branch piping 37 branched from the common supply piping 32 passes in front of or behind the supply sub-tank 18 to be connected to the filter accommodation part 31 without passing over the supply sub-tank 18.

By wetting the surface of the filter 29 on the ejection head 12 side with the ink in the manner described above, it becomes possible to prevent surface tension from occurring at the surface of the filter 29 on the ejection head 12 side and cause the ink to pass through the filter 29.

As a result, the ink supplied to the supply sub-tank 18 passes through the filter 29, the gap 39, and the second supply piping 36, and is supplied to the ejection head 12.

As described above, the branch piping is provided, and the ink supplied from the common supply piping is directly ejected to the surface of the filter on the ejection head side. Thus, even in the case where the ink remains in the filter when the ink is circulated again after the ink circulation is temporarily stopped, and the ink is extracted from the ejection head and the ink circulation path to be returned to the main tank after use of the ink jet recording apparatus, it becomes possible to cause the ink in the supply sub-tank to pass through the filter. That is, it becomes possible to prevent the ink flow from being blocked at the filter when the ink is circulated again, which makes it possible to suitably supply the ink to the ejection head.

As a result, it becomes possible to supply the ink from which foreign matter has been suitably removed by the filter to the ejection head at a constant pressure and suitably supply the ink to the ejection head even at the time of start of the ink circulation.

Here, even when the branch piping 37 is provided, by arranging the filter 29 and the gap 39 lower than the gas-liquid interface of the supply sub-tank 18, that is, an opening portion of the overflow pipe 18*a*, the insides of the filter 29, the gap 39 and the branch piping 37 are placed under a state in which they are filled with the ink, after the ink circulation is started and a predetermined time has passed. Also, the ink excessively supplied to the supply sub-tank 18 is recovered through the overflow pipe 18*a*, so even when the branch piping 37 and the gap 39 are provided, it becomes possible to keep a pressure of the ink supplied to the ejection head 12 constant.

Further, in the case of the ink supply through the branch piping 37, the ink is subjected to the foreign matter removal by the filter 27 and then is supplied to the gap 39 without foreign matter being mixed into the ink, so even when the ink is supplied to the ejection head 12 not through the filter 29, it is possible to prevent mixing of foreign matter from occurring.

It should be noted here that by wetting a part of the surface of the filter 29 on the ejection head 12 side with the ink, the part of the surface on the ejection head 12 side wet with the ink spreads out gradually due to the ink passed through the filter 29 and the whole surface of the filter 29 on the ejection head 12 side becomes finally wet with the ink. Consequently, according to the present invention, by placing at least a part of the filter 29 under a state in which passage of the ink is possible, at the time of start of the ink circulation, it becomes possible to place the whole surface of the filter 29 under the state in which the passage of the ink is possible.

Also, in the ink jet recording apparatus according to the present invention, it is sufficient that in the case where the ink remains in the filter when the ink is supplied to the ejection head again (when the circulation is resumed) after the ink circulation is temporarily stopped (pump is stopped) and the ink is extracted from the ejection head and the ink circulation path to be returned to the main tank at least after use of the ink jet recording apparatus, the ink is directly ejected to the surface of the filter on the ejection head side until the filter is placed under the state in which the ink has been passed therethrough. For instance, a control valve and a control part that controls the control valve are provided in the branch piping. With this construction, only for a predetermined time from a time of resumption of the circulation, the control part opens the control value and supplies the ink to the branch piping to cause the branch piping to directly eject the ink to the filter surface. Following this, when the predetermined time has passed and the filter is placed under the state in which the ink has passed therethrough, the control part closes the control valve to stop the ink supply from the branch piping.

Here, in the embodiment shown in FIG. 1, the ink is passed through the filter, by providing the branch pipe branching from the common supply piping and directly ejecting the ink supplied from the common supply piping to the surface of the filter on the ejection head side. However, the present invention is not limited to this and the ink supplied from the common supply piping may be directly ejected to the surface of the filter on a gas-liquid interface side, for instance. Even with this construction, it becomes possible to prevent a situation from occurring, in which when the ink supply to the ejection head is resumed (when the circulation is started) after the ink circulation is temporarily stopped (pump is stopped) and the ink is extracted from the ejection head and the ink circulation path and is returned to the main tank after use of the ink jet recording apparatus, the ink cannot pass through the filter because the ink remains in the filter.

Figure 2:
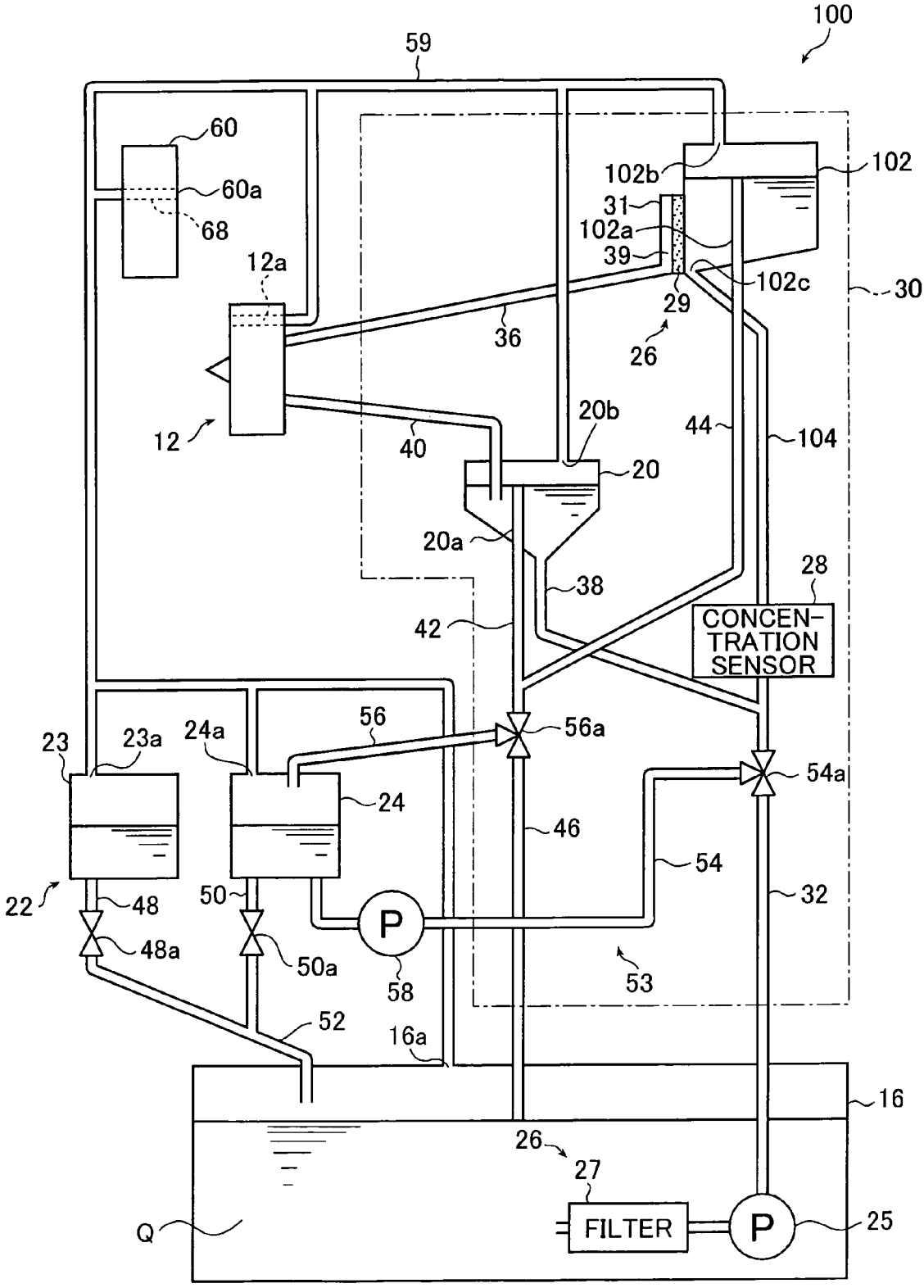
FIG. 2 is a conceptual diagram of another embodiment of the ink jet recording apparatus according to the present invention.

FIG. 2 shows an ink jet recording apparatus that directly ejects the ink supplied from the common supply piping to the gas-liquid interface side of the filter as another embodiment of the ink jet recording apparatus according to the present invention.

Here, an ink jet recording apparatus 100 shown in FIG. 2 has the same construction and shape as the ink jet recording apparatus 10 shown in FIG. 1 except for the shapes of the first supply piping and the supply sub-tank and omission of the branch piping. Therefore, each same construction element is given the same reference symbol, description thereof will be omitted, and only different points will be described in the following explanation.

A supply sub-tank 102 of the ink jet recording apparatus 100 shown in FIG. 2 is an enclosed ink tank to which a first supply piping 104 and a second supply piping 36 are connected, and is arranged at a position higher than an ejection head 12 in a vertical direction. Here, the supply sub-tank 102 of this embodiment has a construction in which an opening 102*c* for connection with the first supply piping 104 is formed in proximity to the filter 29. Further, a bottom surface of the supply sub-tank 102 is inclined toward the opening 102*c* in its entirety so that the opening 102*c* becomes the lowermost portion of the supply sub-tank 102. Further, in the supply sub-tank 102, like in the case of the supply sub-tank 18 shown in FIG. 1, an overflow pipe 102*a* is provided.

In addition, the filter 29 is inserted between the supply sub-tank 102 and the second supply piping 36, and is connected to the second supply piping 36 through the gap 39.

One end of the first supply piping 104 is connected to a common supply piping 32 and the other end thereof is connected to the supply sub-tank 102. Here, a part of the first supply piping 104 of this embodiment on the supply sub-tank 102 side is inclined by a predetermined angle toward the filter 29 side, and is connected to the supply sub-tank 102. That is, the first supply piping 104 and the supply sub-tank 102 are arranged so that a flow direction of ink supplied from the first supply piping 104 to the supply sub-tank 102 intersects with a surface of the filter 29.

As described above, in the ink jet recording apparatus 100 shown in FIG. 2, the opening of the supply sub-tank 102 for connection with the first supply piping 104 is provided in proximity to the filter 29 and is provided so that the flow direction of the ink supplied from the first supply piping 104 to the supply tank 102 intersects with the surface of the filter 29. As a result, the ink supplied from the ink tank 16 to the supply sub-tank 102 through the common supply piping 32 and the first supply piping 104 is directly ejected to the filter 29. That is, the ink supplied from the main tank 16 to the supply sub-tank 102 impinges on the filter 29 at a predetermined flow speed or more. Here, it is sufficient that the liquid current of the ink that impinges on the filter 29 has a flow speed at which when the ink impinges on the surface of the filter 29, the flow speed of the liquid current overcomes surface tension of the ink remaining on the surface of the filter 29 on the ejection head 12 side.

By directly ejecting the ink toward the filter 29 in the manner described above, it becomes possible to break the surface tension of the ink on the surface of the filter 29 and cause the ink to pass through the filter 29. As a result, the ink supplied to the supply sub-tank 102 passes through the filter 29, the gap 39 and the second supply piping 36, and is supplied to the ejection head 12.

Also, by arranging the filter 29 and the gap 39 lower than a gas-liquid interface of the supply sub-tank 102, the insides of the filter 29 and the gap 39 are placed under a state in which they are filled with the ink. Further, the ink excessively supplied to the supply sub-tank 102 is recovered through the overflow pipe 102*a*, so it becomes possible to keep a pressure of the ink supplied to the ejection head 12 constant.

As a result, the ink supplied to the supply sub-tank 102 passes through the filter 29, the gap 39 and the second supply piping 36, and is supplied to the ejection head 12 at a constant pressure.

Even when the filter is provided on the ejection head side with respect to the gas-liquid interface of the supply sub-tank as shown in FIGS. 1 and 2, by directly ejecting the ink supplied from the common supply piping to one of the surface of the filter on the ejection head side and the surface of the filter on the gas-liquid interface side (by performing direct ejection), it becomes possible to destroy balance of the surface tension of the ink on the surface of the filter on the ejection head side. As a result, it becomes possible to suitably circulate the ink while preventing the ink circulation from being blocked by the filter even at the time of start of the ink circulation, and supply the ink from which foreign matter has been removed to the ejection head.

Here, the shapes of the supply sub-tank 18 (102) and the gap 39 are not limited to those described above and various other shapes are usable so long as it is possible to supply the ink to the ejection head 12 in a static pressure system.

Also, as described above, the ink can be automatically recovered to the ink tank when the pump is stopped, so that preferably, the supply sub-tank is provided with the overflow piping, the connection opening with the first supply piping is formed in the lowermost portion of the supply sub-tank, and the connection opening with the second supply piping is formed in the tank side surface of the supply sub-tank as shown in FIGS. 1 and 2. However, the present invention is not limited to this and various other static pressure circulation mechanisms are usable.

As a preferable form, the recording apparatus 10 includes the ink replenishment means 22, the cleaning means 53, the communication piping 59, and the capping member 60.

The ink replenishment means 22 replenishes the main tank 16 with a consumed amount of the ink Q, and basically includes a high concentration replenishment liquid tank 23, a dilution replenishment liquid tank 24, replenishment pipings 48, 50 and 52, and replenishment control valves 48*a* and 50*a*.

The high concentration replenishment liquid tank 23 is an enclosed tank that reserves concentrated ink (high concentration ink=ink containing a large amount of colorant particles), and is connected to the main tank 16 through the replenishment pipings 48 and 52.

On the other hand, the dilution replenishment liquid tank 24 is an enclosed tank that reserves a carrier liquid used as a diluent of the ink at the time of replenishment of the ink Q, and is connected to the main tank 16 through the pipings for replenishment 50 and 52.

Here, the replenishment control valves 48*a* and 50*a* are respectively arranged for the replenishment pipings 48 and 50, and predetermined amounts of the concentrated ink and the diluent are fed into the main tank 16 by opening/closing the replenishment control valves 48*a* and 50*a* as necessary.

By replenishing the main tank with the concentrated ink and the diluent in the manner described above, it becomes possible to place the main tank under a state in which a predetermined amount of the ink Q having a predetermined concentration is reserved.

It should be noted here that in the present invention, the concentration of the concentrated ink is not specifically limited. Also, ink having the same concentration as an intended concentration of the ink Q may be used as ink for replenishment having a predetermined concentration. Further, the replenishment may be performed using multiple kinds of concentrated ink whose concentrations are different from each other.

Here, in the recording apparatus 10, a concentration sensor 28 is provided midway through the first supply piping 34 between the common supply piping 32 and the supply sub-tank 18. The concentration sensor 28 detects the concentration of the ink circulated through the ink circulation path 30. The concentration sensor 28 monitors the ink concentration at all times, and when the ink concentration is increased or decreased, the ink replenishment means replenishes the main tank 16 with the ink. That is, the ink concentration is optimized by supplying the concentrated ink and the diluent from the high concentration replenishment liquid tank 23 and the dilution replenishment liquid tank 24 to the main tank 16. As a result, it becomes possible to record images on recording media in an optimum concentration at all times.

It should be noted here that the concentration sensor may be provided for the third supply piping 38. As described above, the ink supplied to the third supply piping 38 is the same as the ink flowing through the first supply piping 34. Therefore, even with this construction, it becomes possible to measure the concentration of the ink supplied to the ejection head 12 with precision. In addition, the ink supplied to the third supply piping 38 is recovered to the main tank 16 through the recovery sub-tank 20 and the second recovery piping 42, so it becomes possible to further reduce an influence of the ink concentration measurement on the ink circulation.

In the recording apparatus 10, the timing of the replenishment of the ink Q is not specifically limited. For instance, the ink Q replenishment may be automatically performed each time a predetermined number of images have been drawn. Alternatively, the ink Q replenishment may be automatically performed in accordance with a result of detection of the amount of the ink Q in the main tank 16, an instruction inputted by an operator or the like observed and assessed a drawn image, or a result of detection of the ink concentration of a finished image by an apparatus. Alternatively, multiple timing determination means may be provided and the ink Q replenishment may be performed selectively.

Further, a method of determining the replenishment amounts of the concentrated ink and the diluent is not specifically limited. For instance, it is sufficient that by using the total number of times of ink ejection found based on image data or the like, a result of measurement of the concentration of the circulated ink, the amount of the ink in the main tank 16 or the like in addition to an ink predicted evaporation amount, the consumption amount of the ink Q is predicted, and the replenishment amount of the ink is determined so that the predetermined amount of the ink Q having the predetermined concentration is reserved in the main tank 16.

The cleaning means 53 includes a cleaning liquid supply piping 54, a cleaning liquid recovery piping 56, three-way control valves 54*a* and 56*a*, and a pump 58.

One end of the cleaning liquid supply piping 54 is connected to the dilution replenishment liquid tank 24 and the other end thereof is connected to the three-way control valve 54*a* provided for the common supply piping 32. Further, the pump 58 is provided for the cleaning liquid supply piping 54. On the other hand, one end of the cleaning liquid recovery piping 56 is connected to the dilution replenishment liquid tank 24, and the other end thereof is connected to the three-way control valve 56*a* provided for a common recovery piping 46.

Next, an operation of the recording apparatus 10 at the time of cleaning will be described.

First, the pump 25 is stopped and the ink in the ink circulation path 30 (constructed by the supply sub-tank 18, the recovery sub-tank 20, and the pipings connecting them to each other) is recovered to the main tank 16. Then, the three-way control valve 54*a* is switched from the main tank 16 side to the cleaning liquid supply piping 54 side and the three-way control valve 56*a* is switched from the main tank 16 side to the cleaning liquid recovery piping 56 side.

Following this, by the pump 58, the diluent in the dilution replenishment liquid tank 24 is circulated through the cleaning liquid supply piping 54, the supply sub-tank 18, the ejection head 12, the recovery sub-tank 20 and the pipings connecting them to one another, and is recovered through the three-way valve 56*a* and the cleaning liquid recovery piping 56. In this manner, the ejection head 12 and the ink circulation path 30 can be cleaned.

By performing the cleaning of the path in the manner described above, it becomes possible to prevent the ink from remaining in portions other than the main tank with more reliability.

In addition, in this embodiment, the cleaning is performed after the ink in the ink circulation path is recovered to the main tank, so contamination of the diluent used in the cleaning is suppressed and changes of the ink concentration are also suppressed. Therefore, it becomes unnecessary to dispose of the diluent used in the cleaning and it becomes possible to reuse the diluent. As a result, it becomes possible to use the cleaning liquid with efficiency. In addition, it becomes unnecessary to provide a waste liquid tank and a cleaning liquid tank, so it becomes possible to further simplify an apparatus construction.

Here, it is preferable that the cleaning be performed by using the diluent as the cleaning liquid to obtain the above effects. However, the present invention is not limited to this. For instance, a tank reserving the cleaning liquid may be provided and the circulation path may be cleaned by circulating the cleaning liquid in the cleaning liquid tank by known means.

The capping member 60 is a member that is attached to an ejection port side of the ejection head 12 at the time the ink circulation is stopped or drawing is not performed for a long time to place every ejection port of the ejection head 12 under a state in which communication with the outside air is cut off. Thus, the capping member 60 is capable of preventing drying/adhesion of the ink Q remaining at the ejection ports due to evaporation of the ink Q from occurring. As shown in FIG. 1, in a surface of the capping member 60 on an ejection head 12 side, communication ports 60*a* are formed. The communication ports 60*a* are connected to the communication piping 59 to be described later.

The capping member 60 is not limited to capping members used in electrostatic ink jet recording apparatus, and capping members ordinarily used in various other ink jet recording apparatus are also usable.

A construction of the capping member 60 will be described in detail later.

Also, in the ejection head 12 of this embodiment, communication ports 12*a* are formed in a surface in which the ejection ports are formed (surface on a capping member (described later) side). The communication ports 12*a* are connected to the communication piping 59 (described later) passing through the inside of the ejection head 12.

Here, it is preferable that the communication ports 12*a* be arranged at positions higher than a portion in which the ejection ports are formed in a gravity direction, thereby making it possible to prevent the communication ports 12*a* from being blocked with the ink overflowed through the ejection ports. In addition, it is also preferable that the communication ports 12*a* be formed in a shape in which they protrude with respect to a surface in which the ejection ports are formed, and it is also preferable that ink repellent treatment be performed in peripheral regions of the communication ports 12*a*. With the constructions described above, it becomes possible to prevent the communication ports 12*a* from being blocked with the ink overflowed through the ejection ports with more reliability.

Here, openings 16*a*, 18*b* (102*b* of FIG. 2), 20*b*, 23*a*, and 24*a* are respectively provided for the ink tank 16, the supply sub-tank 18, the recovery sub-tank 20, the high concentration replenishment liquid tank 23, and the dilution replenishment liquid tank 24 of the recording apparatus 10.

The communication piping 59 is connected to the openings 16*a*, 18*b*, 20*b*, 23*a* and 24*a*, and the openings communicate with one another through the communication piping 59. The communication piping 59 allows air portions of the main tank 16, the supply sub-tank 18, the recovery sub-tank 20, and the ink replenishment means 22 (including the high concentration replenishment liquid tank 23 and the dilution replenishment liquid tank 24) to communicate with one another so that the same atmosphere exists in the air portions.

In addition, the communication piping 59 is connected to the communication ports 12*a* formed in the ejection head 12 and communication ports 60*a* formed in the capping member 60. Here, the ejection head 12 and the capping member 60 are arranged in an outside air environment, so the communication piping 59 communicates with the outside air through the communication ports 12*a* and 60*a*. As a result, the same pressure as that of the outside air exists inside the main tank 16, the supply sub-tank 18, the recovery sub-tank 20, and the ink replenishment means 22.

Here, as described above, during non-operating state, the capping member 60 is attached to the ejection head 12, thereby cutting off communication between the ejection ports and the outside air. Also, when the capping member 60 is attached to the ejection head 12, the communication ports 12*a* and 60*a* respectively formed in the ejection head 12 and the capping member 60 are closed, thereby cutting off communication between the communication ports 12*a* and 60*a*, and the outside air. As a result, communication between the insides of the main tank 16, the supply sub-tank 18, the recovery sub-tank 20 and the ink replenishment means 22, and the outside air is also cut off.

As described above, in the ink jet recording apparatus of this embodiment, the communication ports 12*a* and 60*a* that establish communication between the main tank 16, the supply sub-tank 18, the recovery sub-tank 20 and the ink replenishment means 22, and the outside air are arranged in portions (capping surfaces) in which the communication with the outside air is cut off when the capping member 60 is attached to the ejection head 12. With this construction, when the capping member 60 is detached from the ejection head 12, that is, during operation, the main tank 16, the supply sub-tank 18, the recovery sub-tank 20 and the ink replenishment means 22 communicate with the outside air. On the other hand, when the capping member 60 is attached to the ejection head 12, that is, during non-operating state, the communication between the main tank 16, the supply sub-tank 18, the recovery sub-tank 20 and the ink replenishment means 22, and the outside air is cut off.

When the capping member 60 is detached from the ejection head 12, the same pressure as that of the outside air is constantly applied onto the liquid surface in each ink tank, so it becomes possible to supply the ink from the supply sub-tank 18 to the ejection head 12 with stability and perform stabilized ink ejection from the ejection head 12. Also, when the capping member 60 is attached to the ejection head 12, the communication between each ink tank and the outside air is cut off, so evaporation of the ink is suppressed, which makes it possible to prevent drying/adhesion of the ink and an increase in ink concentration ascribable to the evaporation of the ink from occurring. As a result, even when recording is not performed for a long time, it becomes possible to eliminate a necessity of or simplify maintenance work and it also becomes possible to conduct stabilized ink concentration management.

Also, by forming the communication ports 12*a* and 60*a* respectively in the ejection head 12 and the capping member 60, it becomes possible to perform switching between a state in which the ink tanks communicate with the outside air, and a state in which the communication of the ink tanks with the outside air is cut off, merely through attachment/detachment of the capping member 60 to/from the ejection head 12. As a result, with a simple apparatus construction in which no special apparatus is provided, it becomes possible to control the atmosphere in the tanks in which the ink is reserved.

Further, when the capping member 60 is attached to the ejection head 12, there exists an atmosphere filled with vapor of the ink that is the same as that in the ink tank in a space formed between the ejection head 12 and the capping member 60, so it becomes possible to prevent drying of the ejection ports of the ejection head 12 from occurring with more reliability.

In this embodiment, the communication piping 59 is connected to the main tank 16, the supply sub-tank 18, the recovery sub-tank 20 and the ink replenishment means 22. However, the present invention is not limited to this and it is sufficient that the communication piping 59 is connected to at least one of the ink tanks. By thus forming the communication piping and at least one ink tank (or air circulation system formed by them) in a communication space which is sealed from the outside air at the time of capping, it becomes possible to perform stabilized recording.

Here, it is preferable that multiple ink tanks including the supply sub-tank 18 be connected to the communication piping 59. By connecting the supply sub-tank 18 to the communication piping 59, it becomes possible to supply the ink to the ejection head 12 with stability and perform more stabilized recording.

Figure 3:
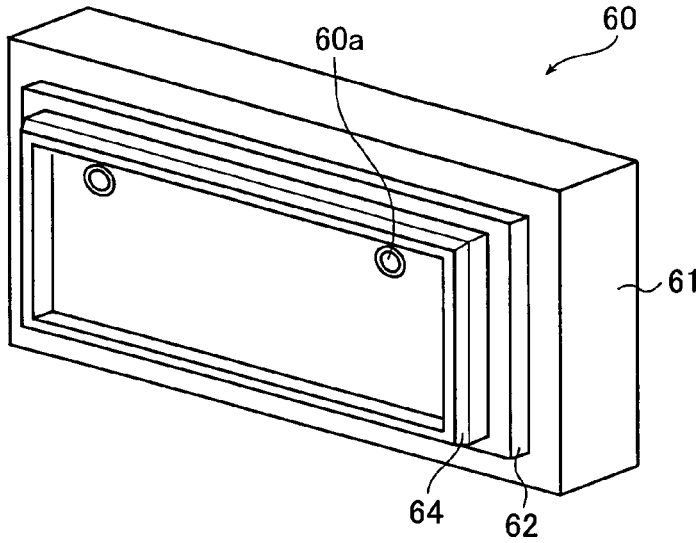
FIG. 3 is a perspective view showing a schematic construction of a capping member of the ink jet recording apparatus shown in FIG. 1.
Figure 4A:
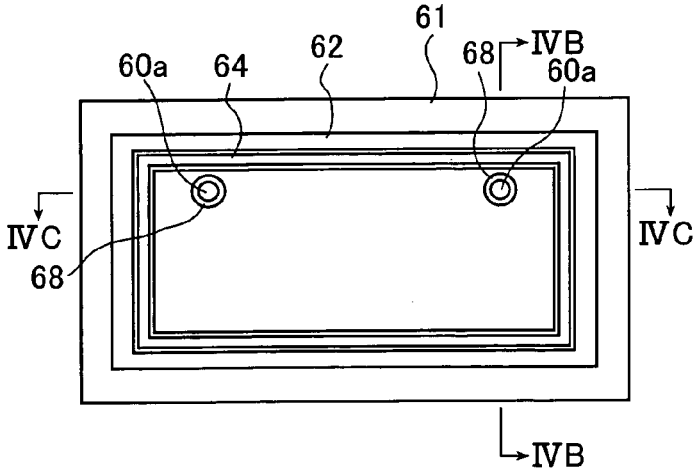
FIG. 4A is a front view of the capping member shown in FIG. 3.
Figure 4B:
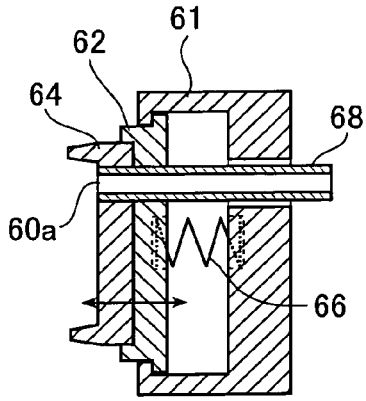
FIG. 4B is a cross-sectional view of the capping member taken along a line IVB-IVB of FIG. 4A.
Figure 4C:
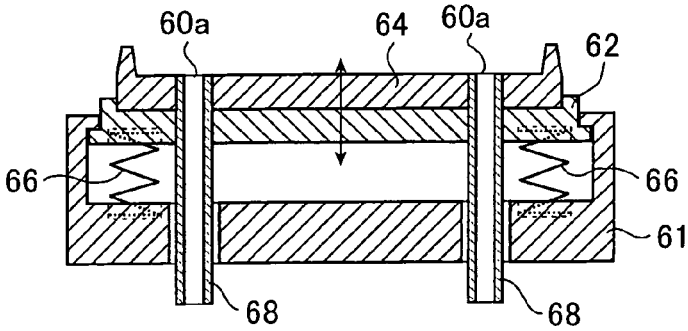
FIG. 4C is a cross-sectional view of the capping member taken along a line IVC-IVC of FIG. 4A.

Next, a structure of the capping member 60 will be described in detail with reference to FIG. 3 and FIGS. 4A to 4C. Here, FIG. 3 is a perspective view schematically showing the construction of the capping member of the ink jet recording apparatus shown in FIG. 1, FIG. 4A is a front view of the capping member shown in FIG. 3, FIG. 4B is a cross-sectional view taken along the line IVB-IVB of FIG. 4A, and FIG. 4C is a cross-sectional view taken along the line IVC-IVC of FIG. 4A.

As described above, the capping member 60 is a member that makes every ejection port of the ejection head 12 under a state in which communication with the outside air is cut off when the ink circulation is stopped or drawing is not performed for a long time to prevent drying/adhesion due to evaporation of the ink Q remaining at the ejection ports from occurring.

The capping member 60 includes a rubber member for capping 64 that includes the communication ports 60*a* and contacts the ejection head 12, a rubber holding member 62 for supporting the rubber member for capping 64, pressing pressure adjustment springs 66 for adjusting a pressing pressure against the ejection head 12, a case 61, and communication tubes 68 for connecting the communication ports 60*a* to the communication piping 59.

The rubber member for capping 64 is a lid member having a rectangular surface wider than an ejection port formed surface of the ejection head 12, and its outer peripheral portion of the rectangular surface on a side opposed to the ejection head 12 has a structure that is convex on the ejection head 12 side. When the capping member 60 is attached to the ejection head 12, only the outer peripheral portion of the rubber member for capping 64 contacts the ejection port formed surface of the ejection head. The outer peripheral portion of the rubber member for capping 64 thus contacts the ejection port formed surface of the ejection head 12, thereby cutting off communication between the ejection ports and the outside air. With the construction described above in which it is possible to cut off the communication between the ejection ports of the ejection head 12 and the outside air without directly contacting the ejection ports of the ejection head 12, it becomes even possible to use ejection heads having ejection ports in complicated shapes or including ink guides in the ink jet recording apparatus according to the present invention.

It is preferable that the rubber member for capping 64 is capable of closely contacting with the ejection port formed surface and have ink resistance. Therefore, the rubber member for capping 64 is formed of rubber having flexibility or a foam member, for instance. More specifically, NMR rubber whose hardness is not more than 60 degrees, fluoro rubber or the like can be used.

Also, the communication ports 60*a* are formed in a surface of the capping member 60. Two communication ports are formed in the illustrated example, but the number of the communication ports is not limited to this and may be changed.

The rubber holding member 62 is provided on the surface of the rubber member for capping 64 which is opposite to that contacting the ejection head 12, and holds the rubber member for capping 64. The rubber holding member 62 is formed of a material having stiffness and ink resistance. More specifically, a metal such as stainless steel and aluminum, or hard plastic such as polyether ether ketone (PEEK), polycarbonate (PC) and hard vinyl chloride, can be used.

The pressing pressure adjustment springs 66 are arranged between the rubber holding member 62 and the case 61, and adjust the pressing pressure of the rubber member for capping 64 against the ejection head 12. Here, it is preferable that multiple pressing pressure adjustment springs 66 be provided at predetermined intervals as shown in FIG. 4C so that the pressing pressure against the ejection head 12 can be kept constant.

The case 61 is intended for accommodating and holding the rubber holding member 62 in a movable manner in an arrow direction shown in FIG. 4C. The rubber holding member 62 which is accommodated in the case 61 and holds the rubber member for capping 64 is pressed toward the ejection port formed surface of the ejection head 12 at an appropriate pressure by the pressing pressure adjustment springs 66. Also, the rubber holding member 62 is held with the multiple pressing pressure adjustment springs 66, so even in the case where the rubber member for capping 64 and the ejection port formed surface of the ejection head 12 are arranged obliquely to each other, when the case 61 is moved toward the ejection port formed surface of the ejection head 12 and the rubber member for capping 64 is brought into contact with the ejection port formed surface of the ejection head 12, the rectangular surface of the rubber member for capping 64 is tilted to contact the ejection port formed surface of the ejection head 12 in a state in which the rectangular surface of the rubber member for capping 64 is in parallel with the ejection port formed surface of the ejection head 12. As a result, the ejection port formed surface of the ejection head 12 is firmly sealed by the rubber member for capping 64. It is sufficient that the case 61 has a construction so that it is moved toward the ejection head 12 by a motor mechanism, a pressure mechanism or the like. The case 61 is moved to be abutted against the ejection port formed surface of the ejection head 12 at the time of capping.

Here, it is preferable that the case 61 is produced using a material having stiffness and ink resistance. More specifically, it is preferable that a metal such as stainless steel and aluminum, and hard plastic such as polyether ether ketone (PEEK), polycarbonate (PC) and hard vinyl chloride be used.

The communication tubes 68 are provided so as to pass through the rubber member for capping 64, the rubber holding member 62 and the case 61. End portions on the rubber member for capping 64 side of the communication tubes 68 form the communication ports 60*a*, and end portions on the case 61 side thereof are connected to the communication piping 59 (not shown).

Here, in the present invention, a method of controlling the attachment and detachment of the capping member 60 to and from the ejection head 12 is not specifically limited. For instance, the capping member 60 may be attached at all times except for a time of recording by the ejection head 12 (during operation). Alternatively, the capping member may be attached when recording is not performed for a predetermined time.

Here, in the present invention, it is preferable that the capping member 60 have a construction, such as the construction of this embodiment, in which the ejection ports become the state in which the communication with the outside air is cut off by pressing the cap member with an energization member requiring no external force such as a spring and an elastic member, when the cap moving means is not operated (when the power is off).

With the construction described above, even when a power failure occurs in the state in which the communication between the ejection ports and the outside air is cut off, it becomes possible to maintain the ejection ports in the state in which the communication with the outside air is cut off. Also, it becomes possible to reliably maintain the state in which the communication between the ejection head and each ink tank and the outside air is cut off at the time of not performing the ink circulation.

Figure 5A:
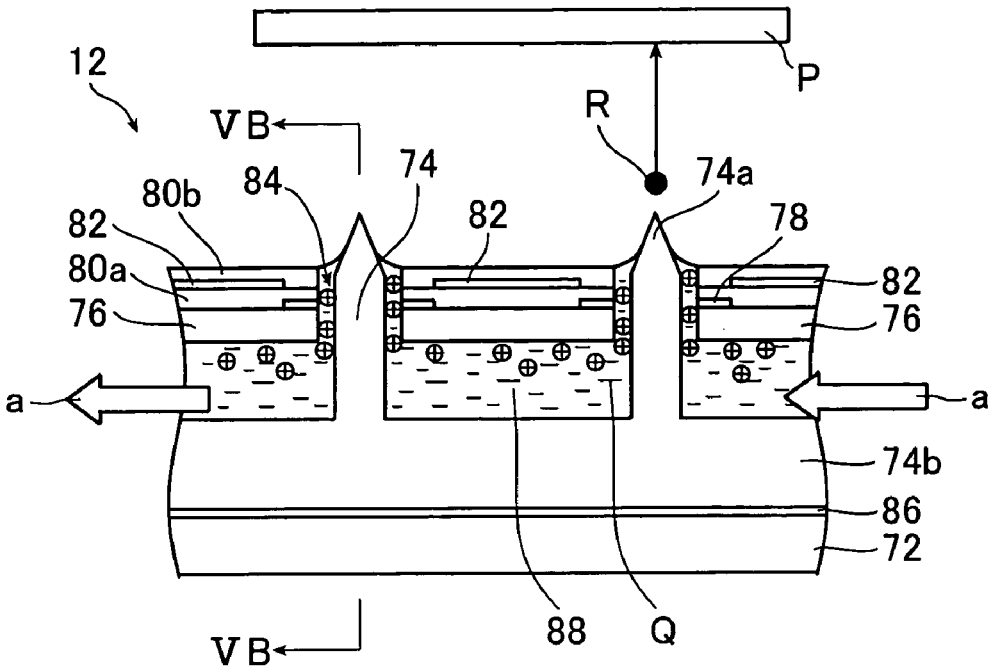
FIG. 5A is a schematic cross-sectional view showing a part of an ejection head.
Figure 5B:
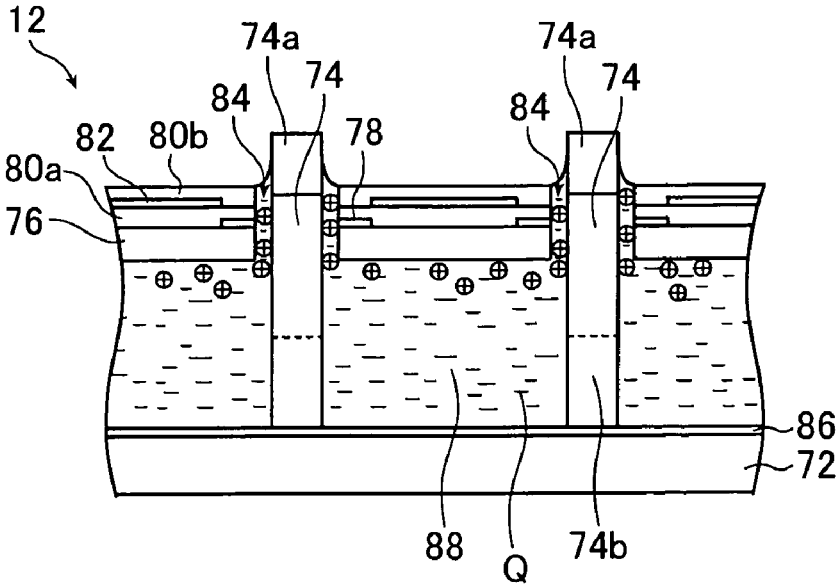
FIG. 5B is a schematic cross-sectional view of the part of the ejection head taken along a line VB-VB of FIG. 5A.
Figure 6:
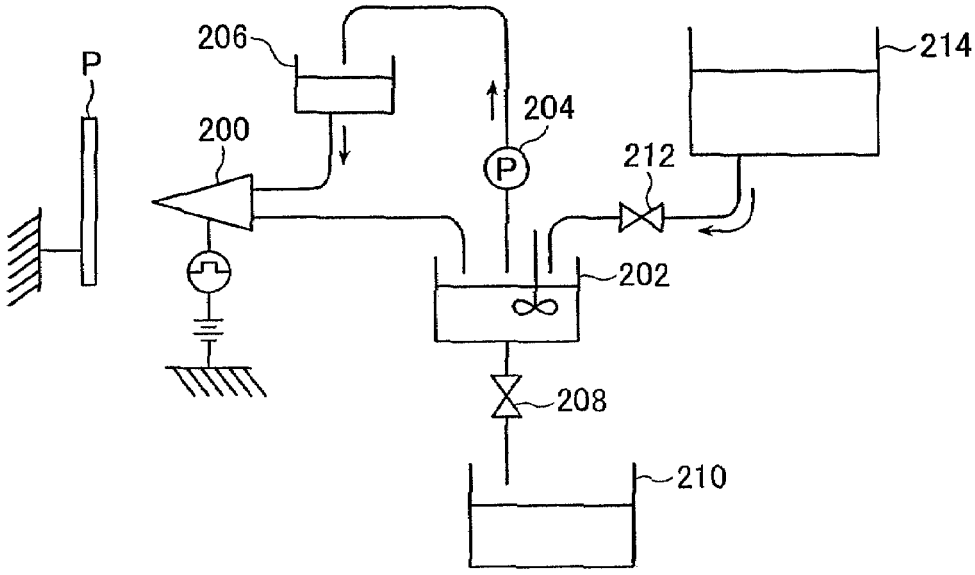
FIG. 6 PRIOR ART
FIG. 6 is a conceptual diagram showing an example of a conventional ink jet recording apparatus.

FIGS. 5A and 5B are each schematic view illustrating a specific configuration of the ejection head 12 in the recording apparatus 10. FIG. 5A is a schematic cross-sectional view showing a part of the ejection head 12, and FIG. 5B is a schematic cross-sectional view taken along the line VB-VB of FIG. 5A. The recording apparatus 10 drives each ejection portion of the ejection head 12 in accordance with a recorded image, that is, supplied image data, to perform ejection on/off, while scanning and conveying the recording medium P charged to a negative high voltage (charged to a bias voltage) in a direction orthogonal to the arrangement direction of the ejection portions (row direction to be described later), thereby ejecting ink droplets R on demand to record a desired image on the recording medium P.

The ejection head 12 is a multi-channel head provided with ejection ports two-dimensionally. Herein, in order to clarify the configuration, only two ejection portions are shown.

The ejection head 12 includes a head substrate 72, ink guides 74, an ejection port substrate 76, ejection port electrodes 78, and a floating conductive plate 86. The ejection head 12 is placed so that the tip end of the ink guide 74 as the ejection (flying) point of an ink droplet R is opposed to the recording medium P.

The head substrate 72 and the ejection port substrate 76 are flat substrates common to all the ejection ports of the ejection head 12, and are made of an insulating material. The head substrate 72 and the ejection port substrate 76 are placed at a predetermined distance from each other, and an ink flow path 88 is formed therebetween. Ink Q in the ink flow path 88 contains colorant particles charged to the voltage identical in polarity to that applied to the ejection electrode 78, and during recording, the ink Q is circulated by the ink circulation mechanism in the ink flow path 88 at a predetermined speed (e.g., ink flow rate of 200 mm/s) in a predetermined direction, and in the example shown in FIG. 5A, from the right side to the left side (direction indicated by an arrow a in FIG. 5A). Hereinafter, the case where the colorant particles in ink are positively charged will be described.

In the ejection port substrate 76, ejection ports 84 serving as ejection ports for the ink Q are formed, and the ejection ports 84 are placed two-dimensionally at predetermined intervals. Furthermore, the ink guide 74 for determining the ejection (flying) point of the ink Q is placed in the center of each ejection port 84.

The ink guide 74 is a plate made of an insulating resin with a predetermined thickness, has a protruding tip end portion 74*a*, and is placed on the head substrate 72 at a position corresponding to each ejection port 84. The ink guide 74 has a base 74*b* common to the ink guides 74 arranged in the same column (in a horizontal direction in FIG. 5A, and in a direction vertical to the paper surface of FIG. 5B), and the base 74*b* is fixed on the head substrate 72 with the floating conductive plate 86 interposed therebetween.

Furthermore, the tip end portion 74*a* of the ink guide 74 is placed so as to protrude from the outermost surface of the ejection head 12 on the recording medium P side. The shape and structure of the tip end portion 74*a* are set so that the ejection point of the ink Q (ink droplet R) can be stabilized and the ink Q can be sufficiently supplied to the tip end portion 74*a*, where the colorant particles in the ink Q are concentrated into a preferable state. For example, the tip end portion 74*a* gradually tapered toward the ejecting direction, the tip end portion 74*a* in which a slit serving as an ink guide groove is formed in a vertical direction in FIG. 5A, the tip end portion 74*a* to which a metal is vapor-deposited to substantially increase the dielectric constant of the tip end portion 74*a*, and the like are preferable.

On the surface (upper surface in FIG. 5A) of the ejection port substrate 76 on the recording medium P side, the ejection electrodes 78 are placed so as to surround the respective ejection ports 84. Furthermore, on the recording medium P side of the ejection port substrate 76, an insulating layer 80*a* covering upper portions (upper surfaces) of the ejection electrodes 78, a sheet-shaped guard electrode 82 placed above the ejection electrodes 78 via the insulating layer 80*a*, and an insulating layer 80*b* covering the upper surface of the guard electrode 82 are provided.

The ejection electrode 78 is placed in a ring shape for each ejection portion (i.e., as circular electrodes) on the upper side of the ejection port substrate 76 in FIG. 5A (i.e., on the surface of the ejection port substrate 76 on the recording medium P side) so as to surround each ejection port 84 formed in the ejection port substrate 76. The ejection electrode 78 is not limited to a circular electrode, and it may be a substantially circular electrode, a divided circular electrode, a parallel electrode, or a substantially parallel electrode.

At the time of image recording, the recording medium P charged to a voltage opposite in polarity to that of the charged colorant particles in ink is conveyed to a position opposed to the ink guide 74 at a predetermined speed while being held by not shown conveying means. The recording medium P is charged to a negative high voltage (e.g., −1500 V), and a predetermined electric field which does not cause ejection of the ink Q is formed between the recording medium P and the ejection electrodes 78.

When the recording medium P is conveyed to a predetermined position, the drive signal is supplied to each ejection head 12 in accordance with the conveying timing of the recording medium P and the image data. Corresponding to this, each ejection head 12 drives the ejection electrodes 78, and performs ejection on/off of the ink in accordance with the image data.

When the ejection electrodes 78 are in ejection off state (ejection standby state), the pulse voltage is set to 0v or a low voltage. In this state, the electric field strength at the ejection portion is set based on the bias voltage (or voltage in which the pulse voltage in the ejection off state is superposed on the bias voltage), which is set lower than electric field strength required to eject the ink Q, thus ejection of the ink Q is not performed. In the ejection standby state, Coulomb attraction acting between the bias voltage and the colorant particles (charged particles) of the ink Q, Coulomb repulsion among the colorant particles, viscosity, surface tension and dielectric polarization force of the carrier liquid, and the like act on the ink Q, and these forces operate in conjunction with one another to move the colorant particles and the carrier liquid. Thus, the balance is kept in a meniscus shape in which the ink Q slightly rises from the ejection port 84.

The colorant particles move toward the recording medium P charged to the bias voltage through a so-called electrophoresis process by the Coulomb attraction and the like. Therefore, the ink Q is concentrated at the meniscus formed in the ejection port 84.

When the ejection electrodes 78 are in the ejection on state, the pulse voltage is applied. That is, the pulse voltage with high voltage (e.g., at 400 to 600 V) is superposed on the bias voltage, and the electric field strength at the ejection portion becomes enough to eject the ink Q. Thus, the motion occurs in which the previous conjunction motion operates in conjunction with the superposition of the drive voltage. Then, the colorant particles and the carrier liquid are attracted toward the bias voltage side (the counter electrode), i.e., the recording medium P side by the electrostatic force. Thus, the meniscus grows upward to form a nearly conical ink liquid column, i.e., the so-called Taylor cone above the ejection port 84. In addition, similarly to the foregoing, the colorant particles are moved to the meniscus surface through the electrophoresis process so that the ink Q at the meniscus is concentrated and has a large number of colorant particles at a nearly uniform high concentration.

When a finite period of time further elapses after the start of the application of the drive voltage, the balance mainly between the force acting on the colorant particles (Coulomb attraction or the like) and the surface tension of the carrier liquid is broken at the tip portion of the meniscus having the high electric field strength due to the movement of the colorant particles or the like. As a result, the meniscus abruptly grows to form a slender ink liquid column called the thread having about several μm to several tens of μm in diameter.

When a finite period of time further elapses, the thread grows, and is divided due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. The divided thread is then ejected and flown in the form of the ink droplets R and is attracted by the bias voltage as well to adhere to the recording medium P.

The growth of the thread and its division, and moreover the movement of the colorant particles to the meniscus and/or the thread are continuously generated while the drive voltage is applied. After the end of the application of the drive voltage, the meniscus returns to the state where only the bias voltage is applied to the recording medium P.

One dot of ink is normally formed onto the recording medium P by applying the drive voltage once (one pulse), so that ink droplets R which are divided from the thread and ejected by applying the drive voltage once form one dot.

The size of the ink droplet R is extremely small, so that recording of an image having high resolution and high image quality can be performed.

Thus, on/off control of ejecting ink is performed on the ejection electrode 78 of each ejection portion arranged over the entire width of the recording medium P in accordance with image data, and ink is ejected at a predetermined timing on the recording medium P conveyed at a predetermined speed, whereby a two-dimensional image is recorded on the recording medium P.

The guard electrode 82 is placed between the ejection electrodes 78 of adjacent ejection portions, and suppresses the interference of an electric field occurring between the ink guides 74 of adjacent ejection portions. The guard electrode 82 is a sheet-shaped electrode such as a metal plate common to all the ejection portions of the ejection head 12, and portions corresponding to the ejection electrodes 78 formed on the periphery of the respective ejection ports 84 arranged two-dimensionally are perforated. By providing the guard electrode 82, even in the case where the ejection ports 78 are arranged at a high density, the influence of an electric field of the adjacent ejection ports 78 can be minimized, and the dot size and the drawing position of a dot can be kept consistently.

On the surface of the head substrate 72 on the ink flow path 88 side, the floating conductive plate 86 is placed. The floating conductive plate 86 is electrically insulated (in a high impedance state). The floating conductive plate 86 generates an induced voltage in accordance with the value of the voltage applied to the ejection portion during image recording, and allows the colorant particles to migrate to the ejection port substrate 76 side in the ink Q flowing in the ink flow path 88. Furthermore, on the surface of the floating conductive plate 86, an electrically insulating coating film (not shown) is formed, whereby the physical properties and components of ink are prevented from becoming unstable due to charge injection into the ink and the like. As the insulating coating film, the one having resistance to corrosion caused by ink can be used.

By providing the floating conductive plate 86, the colorant particles in the ink Q flowing in the ink flow path 88 are allowed to migrate to the ejection port substrate 76 side to increase the concentration of the colorant particles in the ink Q flowing through the ejection ports 84 of the ejection port substrate 76 to a predetermined level to concentrate the ink Q at the tip end portion 74*a* of the ink guide 74, whereby the concentration of the colorant particles in the ink Q to be ejected in the form of the ink droplet R can be stabilized at the predetermined level.

In the illustrated example, the ejection electrodes have a single layer electrode structure. However, the ejection electrodes may have, for example, a two-layer electrode structure which includes first ejection electrodes connected in a column direction and second ejection electrodes connected in a row direction, and in which the first ejection electrodes and the second ejection electrodes are arranged in a matrix to perform matrix driving. According to such a matrix driving system, the higher integration of the ejection electrodes and the simplification of the driver wiring can be realized simultaneously.

Furthermore, in the above embodiment, the colorant particles in the ink Q are positively charged, and the recording medium P is charged to a negative high voltage, however, the present invention is not limited to this. Contrary to the above, the colorant particles in the ink Q may be negatively charged, and the recording medium P may be charged to a positive high voltage. When the charged colored particles have the polarity opposite to that in the above-mentioned embodiment, the polarity of the applied voltage to the counter electrode, the charging unit for the recording medium P, the ejection electrode 78 of each ejection portion, and the like is changed opposite to the above embodiment.

The ink used in the recording apparatus in the present invention will be explained.

The ink Q is obtained by dispersing colorant particles in a carrier liquid. It is preferable that the carrier liquid be a dielectric liquid (non-aqueous solvent) having a high electric resistivity ($10^9$ Ω·cm or more, preferably $10^{10}$ Ω·cm or more).

If the electrical resistivity of the carrier liquid is low, the concentration of the colorant particles does not occur since the carrier liquid itself receives the injection of the electric charges to be charged due to a drive voltage applied to the ejection electrodes. In addition, since there is also anxiety that the carrier liquid having a low electrical resistivity causes the electrical conduction between the adjacent ejection electrodes, the carrier liquid having a low electrical resistivity is unsuitable for the present invention.

The relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby the electric field effectively acts on the colorant particles contained in the carrier liquid to facilitate the electrophoresis of the colorant particles.

Note that the upper limit of the specific electrical resistance of the carrier liquid is desirably about $10^{16}$ Ω·cm, and the lower limit of the relative permittivity is desirably about 1.9. The reason why the electrical resistance of the carrier liquid preferably falls within the above-mentioned range is that if the electrical resistance becomes low, then the ejection of the ink droplets under a low electric field becomes worse. Also, the reason why the relative permittivity preferably falls within the above-mentioned range is that if the relative permittivity becomes high, then the electric field is relaxed due to the polarization of the solvent, and as a result the color of dots formed under this condition becomes light, or the bleeding occurs.

Preferred examples of the dielectric liquid used as the carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent, (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid (ink solvent), colorant itself may be dispersed as the colorant particles into the carrier liquid, but dispersion resin particles are preferably contained for enhancement of fixing property. In the case where the dispersion resin particles are contained in the carrier liquid, in general, there is adopted a method in which pigments are covered with the resin material of the dispersion resin particles to obtain particles covered with the resin, or the dispersion resin particles are colored with dyes to obtain the colored particles.

As the color material, pigments and dyes conventionally used in ink compositions for ink jet recording, (oily) ink compositions for printing, or liquid developers for electrostatic photography may be used.

Pigments used as color material may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as color material include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of dispersion resin particles include rosins, rosin-modified phenol resin, alkyd resin, a (meth)acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In ink Q, the content of colorant particles (total content of colorant particles and dispersion resin particles) preferably falls within a range of 0.5 to 30 wt % for the overall ink, more preferably falls within a range of 1.5 to 25 wt %, and much more preferably falls within a range of 3 to 20 wt %. If the content of colorant particles decreases, the following problems become easy to arise. The density of the printed image is insufficient, the affinity between the ink Q and the surface of a recording medium P becomes difficult to obtain to prevent the image firmly stuck to the surface of the recording medium P from being obtained, and so forth. On the other hand, if the content of colorant particles increases, problems occur in that the uniform dispersion liquid becomes difficult to obtain, the clogging of the ink Q is easy to occur in the ink jet head or the like to make it difficult to obtain the stable ink ejection, and so forth.

In addition, the average particle diameter of the colorant particles dispersed in the carrier liquid preferably falls within a range of 0.1 to 5 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA LTD.).

After the colorant particles and optionally a dispersing agent are dispersed in the carrier liquid, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

The colorant particles may be positively charged or negatively charged as long as it is identical in polarity to the drive voltages applied to the ejection electrodes.

The charging amount of the colorant particles is preferably in a range of 5 to 200 μC/g, more preferably in a range of 10 to 150 μC/g, and much more preferably in a range of 15 to 100 μC/g.

In addition, the electrical resistance of the dielectric liquid may be changed by adding the charging control agent in some cases. Thus, the distribution factor P defined below is preferably equal to or larger than 50%, more preferably equal to or larger than 60%, and much more preferably equal to or larger than 70%.

$$P=100\times(\sigma1-\sigma2)/\sigma1$$

where σ1 is an electric conductivity of the ink Q, and σ2 is an electric conductivity of a supernatant liquid which is obtained by inspecting the ink Q with a centrifugal separator. Those electric conductivities were measured by using an LCR meter of an AG-4311 type (manufactured by ANDO ELECTRIC CO., LTD.) and electrode for liquid of an LP-05 type (manufactured by KAWAGUCHI ELECTRIC WORKS, CO., LTD.) under a condition of an applied voltage of 5 V and a frequency of 1 kHz. In addition, the centrifugation was carried out for 30 minutes under a condition of a rotational speed of 14,500 rpm and a temperature of 23° C. using a miniature high speed cooling centrifugal machine of an SRX-201 type (manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between the adjacent ejection electrodes.

In addition, the surface tension of the ink Q is preferably in a range of 15 to 50 mN/m, more preferably in a range of 15.5 to 45 mN/m, and much more preferably in a range of 16 to 40 mN/m. The surface tension is set in this range, resulting in that the applied voltages to the ejection electrodes are not excessively high, and also the ink does not leak or spread to the periphery of the head to contaminate the head.

Moreover, the viscosity of the ink Q is preferably in a range of 0.5 to 5 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to the dispersion medium to allow the colorant particles to be charged. The following methods are given as the specific methods.

(1) A method including: previously mixing (kneading) a colorant and optionally dispersion resin particles; dispersing the resultant mixture into a carrier liquid using a dispersing agent when necessary; and adding the charging control agent thereto.

(2) A method including: adding a colorant and optionally dispersion resin particles and a dispersing agent into a carrier liquid at the same time for dispersion; and adding the charging control agent thereto.

(3) A method including adding a colorant and the charging control agent, and optionally the dispersion resin particles and the dispersing agent into a carrier liquid at the same time for dispersion.

The ink jet recording apparatus of the present invention is explained above, however, it is to be understood that the invention is not limited to the above embodiments, and various improvements and modifications may be made without departing from the scope of the present invention.

For example, in the above embodiments, the ink jet recording apparatus of the present invention is applied to the electrostatic concentrated ink jet recording apparatus which uses ink obtained by dispersing colorant particles (charged particles containing colorants) in a carrier liquid, however, the present invention is not limited thereto, and is also suitably applied to an electrostatic non-concentrated ink jet recording apparatus in which ink containing charged particles is not used.

What is claimed is:

1. An ink jet recording apparatus having an ink jet head for ejecting ink, the ink jet recording apparatus comprising:

a main tank for reserving the ink;

a supply sub-tank for reserving the ink supplied from the main tank and supplying the ink to the ink jet head with a static pressure method;

an ink circulation system forming an ink circulation path circulating ink from the main tank to the supply sub-tank to the ink jet head and back to the main tank, the ink circulation path including a first supply piping for connecting the main tank and the supply sub-tank to each other, wherein a gas-liquid interface is formed on the ink circulation path between the supply sub-tank and the ink jet head when ink is circulated; and a filter provided on an ink jet head side of the gas-liquid interface, the filter having a surface on a gas-liquid interface side of the filter and a surface on an ink jet head side of the filter, wherein the ink circulation system is configured to eject at least a part of the ink passing through the first supply piping directly to one of the surface of the filter on the ink jet head side of the filter and the surface of the filter on the gas-liquid interface side of the filter, wherein the ink circulation system further includes a branch piping branching from the first supply piping, and the ink branched from the first supply piping is directly ejected from the branch piping to the surface of the filter on the ink jet head side of the filter.

2. The ink jet recording apparatus according to claim 1, wherein the ink circulation system includes a second supply piping for connecting the supply sub-tank and the ink jet head to each other, and the filter is inserted between the supply sub-tank and the second supply piping.

3. The ink jet recording apparatus according to claim 1, wherein the ink is obtained by dispersing fine particles containing at least a resin and a colorant in a solvent.

4. The ink jet recording apparatus according to claim 1, wherein the branch piping includes an opening for ejecting the ink, and the opening is opposed to the surface of the filter on the ink jet head side of the filter.

5. The ink jet recording apparatus according to claim 1, wherein the supply sub-tank includes a connection port for connection with the first supply piping, and the connection port is formed in proximity to the filter so that the ink ejected from the connection port directly impinges on the surface of the filter on the gas-liquid interface side of the filter.

6. The ink jet recording apparatus according to claim 1, wherein the supply sub-tank includes a connection port in a lowermost position thereof for connection with the first supply piping, and the ink reserved in the supply sub-tank is recovered to the main tank through the first supply piping when the ink circulation is stopped.

7. The ink jet recording apparatus according to claim 1, wherein:

the filter is a first filter; and the ink jet recording apparatus further comprises a second filter provided between the main tank and the sub-tank for ink supply circulation system.

8. The ink jet recording apparatus according to claim 7, further comprising liquid feed means for feeding the ink from the main tank to the supply sub-tank through the first supply piping, wherein the liquid feed means feeds the ink passed through the second filter to the supply sub-tank.

9. The ink jet recording apparatus according to claim 1, wherein the supply sub-tank is arranged at a position higher than the ink jet head, and supplies the ink to the ink jet head while keeping a height of an ink liquid surface constant through overflowing.

10. The ink jet recording apparatus according to claim 1, further comprising a recovery sub-tank for recovering the ink from the ink jet head, wherein the recovery sub-tank is arranged at a position lower than the ink jet head, and recovers the ink from the ink jet head while keeping a height of an ink liquid surface constant through overflowing.

11. The ink jet recording apparatus according to claim 10, wherein the recovery sub-tank includes a connection port in a lowermost position thereof for connection with a third supply piping connected to the main tank, and the ink reserved in the recovery sub-tank is recovered to the main tank through the third supply piping when the ink circulation is stopped.

12. The ink jet recording apparatus according to claim 1, further comprising:

capping means for lidding ink ejection ports of the ink jet head when attached to the ink jet head; and a communication piping for connecting the supply sub-tank and at least one of the capping means and the ink jet head to each other, wherein communication ports are formed in capping surfaces of the capping means and the ink jet head, the communication ports being connected to the communication piping for allowing air in at least one of the supply sub-tank and the main tank to communicate with outside air; and the communication with the outside air through the communication piping is cut off by attaching the capping means to the ink jet head, and the communication with the outside air through the communication piping is established by detaching the capping means from the ink jet head.

13. The ink jet recording apparatus according to claim 1, further comprising ink replenishment means including at least a high concentration ink replenishment portion for replenishing the main tank with high concentration ink and a diluent replenishment portion for replenishing the main tank with a diluent.

14. The ink jet recording apparatus according to claim 13, wherein the diluent replenishment portion is connected to a circulation system that circulates the diluent through the supply sub-tank and the ink jet head.

15. The ink jet recording apparatus according to claim 1, wherein the ink circulation path is constructed only with pipings that are each arranged to be inclined or vertical.

16. The ink jet recording apparatus according to claim 1, wherein the filter comprises a supply sub-tank side and an ink jet head side, and at least at part of the ink passed through the first supply piping is directly ejected to the ink jet head side of the filter.

17. The ink jet recording apparatus according to claim 1, further comprising a control means which controls the flow of ink through the branch piping such that ink flows through the branch piping only until ink has passed through the filter.

18. An ink jet recording apparatus having an ink jet head for ejecting ink, the ink jet recording apparatus comprising:

a main tank for reserving the ink;

a supply sub-tank for reserving the ink supplied from the main tank and supplying the ink to the ink jet head with a static pressure method;

an ink circulation system forming an ink circulation path circulating ink from the main tank to the supply sub-tank to the ink jet head and back to the main tank, the ink circulation path including a first supply piping for connecting the main tank and the supply sub-tank to each other, wherein a gas-liguid interface is formed on the ink circulation path between the supply sub-tank and the ink jet head when ink is circulated; and a filter provided on an ink jet head side of the gas-liquid interface such that ink circulated through the ink circulation path impinges on the filter, the filter having a surface on a gas-liquid interface side of the filter and a surface on a ink jet head side of the filter;

capping means for lidding ink ejection ports of the ink jet head when attached to the ink jet head; and a communication piping for connecting the supply sub-tank and at least one of the capping means and the ink jet head to each other, wherein the supply sub-tank is provided with an opening for connection to the first supply piping, such opening being formed in proximity to the filter, wherein the ink circulation system is configured to circulate the ink that impinges on the filter at a predetermined flow speed which overcomes surface tension of ink on the surface of the filter on the ink jet head side of the filter, wherein communication ports are formed in capping surfaces of the capping means and the ink jet head, the communication ports being connected to the communication piping for allowing air in at least one of the supply sub-tank and the main tank to communicate with outside air; and the communication with the outside air through the communication piping is cut off by attaching the capping means to the ink jet head, and the communication with the outside air through the communication piping is established by detaching the capping means from the ink jet head.

19. The ink jet recording apparatus according to claim 18, wherein the bottom surface of the supply sub-tank is inclined towards the opening for connection to the first supply piping, such that the opening becomes the lowermost portion of the supply sub-tank.

20. An ink jet recording apparatus having an ink jet head for ejecting ink, the ink jet recording apparatus comprising:

a main tank for reserving the ink;

a supply sub-tank for reserving the ink supplied from the main tank and supplying the ink to the ink jet head with a static pressure method;

an ink circulation system forming an ink circulation path circulating ink from the main tank to the supply sub-tank to the ink jet head and back to the main tank, the ink circulation path including a first supply piping for connecting the main tank and the supply sub-tank to each other, wherein a gas-liquid interface is formed on the ink circulation path between the supply sub-tank and the ink jet head when ink is circulated;

a filter provided on an ink jet head side of the gas-liquid interface, the filter having a surface on a gas-liquid interface side of the filter and a surface on an ink jet head side of the filter;

capping means for lidding ink ejection ports of the ink jet head when attached to the ink jet head; and a communication piping for connecting the supply sub-tank and at least one of the capping means and the ink jet head to each other, wherein the ink circulation system is configured to eject at least a part of the ink passing through the first supply piping directly to one of the surface of the filter on the ink jet head side of the filter and the surface of the filter on the gas-liquid interface side of the filter, wherein communication ports are formed in capping surfaces of the capping means and the ink jet head, the communication ports being connected to the communication piping for allowing air in at least one of the supply sub-tank and the main tank to communicate with outside air; and the communication with the outside air through the communication piping is cut off by attaching the capping means to the ink jet head, and the communication with the outside air through the communication piping is established by detaching the capping means from the ink jet head.

* * * * *